US005678374A

United States Patent [19]

Fukuoka

[11] Patent Number: 5,678,374

[45] Date of Patent: Oct. 21, 1997

[54] METHOD OF REINFORCING CONCRETE MADE CONSTRUCTION AND FIXTURE USED THEREFOR

[75] Inventor: Katsumi Fukuoka, Fukuoka, Japan

[73] Assignee: Kyouryou Hozen Inc., Fukuoka, Japan

[21] Appl. No.: 658,567

[22] Filed: Jun. 5, 1996

[30] Foreign Application Priority Data

Jun. 14, 1995 [JP] Japan ..... 7-172810
Aug. 29, 1995 [JP] Japan ..... 7-245361

[51] Int. Cl.[6] ..... E04G 23/02

[52] U.S. Cl. ..... 52/514; 52/597; 52/600; 52/741.3; 14/73; 14/74; 403/384; 403/386; 403/388

[58] Field of Search ..... 52/514, 514.5, 52/597, 600, 741.3; 14/73, 74; 403/384, 386, 388; 411/923, 487, 492, 484, 169, 973, 435, 427, 400

[56] References Cited

U.S. PATENT DOCUMENTS

| | | | |
|---|---|---|---|
| 2,203,294 | 6/1940 | Engle | 411/487 |
| 3,456,549 | 7/1969 | Horton | 411/427 |
| 3,758,939 | 9/1973 | Galvani | 52/514 X |
| 3,889,436 | 6/1975 | Elliott | 52/514 |
| 4,392,335 | 7/1983 | Heiman | 52/514 X |
| 4,512,123 | 4/1985 | Fischer | 52/514.5 |
| 4,711,234 | 12/1987 | Vives et al. | 411/923 X |
| 4,714,507 | 12/1987 | Ohgushi | 52/514 X |
| 5,115,622 | 5/1992 | Ammann et al. | 52/514 X |
| 5,352,002 | 10/1994 | Vovillor et al. | 451/973 X |
| 5,425,152 | 6/1995 | Teron | 14/73 X |
| 5,440,859 | 8/1995 | Cortese | 52/514 X |
| 5,457,839 | 10/1995 | Csagoly | 14/73 |

FOREIGN PATENT DOCUMENTS

A61-146904 7/1986 Japan .

*Primary Examiner*—Carl D. Friedman
*Assistant Examiner*—W. Glenn Edwards
*Attorney, Agent, or Firm*—Griffin, Butler, Whisenhunt & Kurtossy

[57] ABSTRACT

A method of reinforcing a concrete made construction comprising the steps of provisionally disposing a reinforcement member onto a lower surface of a concrete made construction, forming holes at the lower surface of a concrete made construction, and inserting fixtures into the holes to fixate the reinforcement member onto the lower surface of a concrete made construction so that the fixture imparts tension force to the reinforcement member in a plane of the reinforcement member. For instance, a fixture includes a device for applying tension force to the reinforcement member in a plane thereof by moving at least a part of the fixture in a direction perpendicular to the reinforcement member. The invention ensures fixation of a reinforcement member onto a lower surface of a concrete made construction such as a bridge to which repeated live loads are always applied.

14 Claims, 22 Drawing Sheets

METHOD OF REINFORCING CONCRETE MADE CONSTRUCTION AND FIXTURE USED THEREFOR

BACKGROUND OF THE INVENTION

1. Field of the Invention

The invention relates to a method of reinforcing a concrete made construction with a reinforcement member to be secured onto a lower surface of a beam or a floor of a concrete made construction such as a bridge. The invention also relates to a fixture to be used in such a method.

2. Description of the Prior Art

A floor of a bridge receives the largest load or stress among parts constituting the bridge, because moving loads of vehicles are directly applied thereto in repeated fashion. Thus, a crack running in a single direction in particular on a lower surface of a floor is developed to cracks running in many directions, which are further developed like a net, resulting in spallation of concrete of which a bridge is made.

If such spallation is kept as it is without mending, cracks are further developed with the result of corrosion of reinforcing steels which would finally cause the destruction of a construction such as a bridge. Accordingly, appropriate mending has been carried out in order to avoid such destruction when generation of initial cracks was found.

For instance, the followings have been conventionally carried out for mending a construction: introduction of epoxy resin into cracks of a floor of a bride so that epoxy resin becomes integral with concrete of which the bridge is made; formation of a layer such as a sheet and a coated film for preventing water such as rain from penetrating a floor of a bridge; application of fiber-reinforced plastics (FRP) to tension edges of a floor; and filling cavities or spallation with cement mortar or resin mortar.

Those mending methods ensure prevention of degradation of a concrete floor made of concrete and corrosion prevention of reinforcing steels to some degree. However, those methods as mentioned above merely ensure mending of a concrete floor, and do not enhance the strength of a concrete floor.

In order to resolve such a problem, the inventor has suggested a method of mending and reinforcing a construction such as a floor of a bridge in Japanese Unexamined Patent Publication No. 61-146904. This method includes the steps of applying a surface application material onto a surface of a construction which has been cleaned, covering the surface with a wire gauze and applying again a surface application material over the wire gauze.

FIG. 1 is a cross-section illustrating a construction mended and reinforced by the method disclosed in the Publication No. 61-146904. A floor 521 of a concrete made construction is covered with a first impregnated layer 522, is which is covered with a second impregnated layer 523. A wire gauze 524 is fixed over the second impregnated layer 523 with hole-in anchors 525. The wire gauze 524 is further covered with a first application layer 526, which is in turn covered with a second application layer 527.

In order for the wire gauze 524 covering the second impregnated layer 523 to act sufficiently as a reinforcement member, it is necessary for the wire gauze 524 to be sufficiently fixed to the floor 521 by means of the hole-in anchors 525. Such fixation of the wire gauze 524 to the floor 521 ensures almost the same strength as the strength of a construction originally including reinforcing steels corresponding in amount to the wire gauze 524.

The method disclosed in the above mentioned Publication uses the bolt-shaped hole-in anchors 525, which sandwich an intersection of the wire gauze 524 between a head portion **525*a* and a threaded portion 525*b* thereof for fixing the wire gauze 524. Although this method eliminates a risk of falling of the wire gauze 524, it cannot provide sufficient fixation of the wire gauze 524 to the floor 521**.

As mentioned earlier, repeated live loads are always applied to a concrete floor of a bridge by vehicles passing thereon, and cause the concrete floor to repeat vertical deflection with maximum deflection occurring at a center of a span of the bridge. Thus, if the bolt-shaped hole-in anchors 525 are used for fixing the wire gauze 524, there will be produced a gap between the hole-in anchors 525 and the wire gauze 24 as times go by, resulting in that it is no longer possible to sufficiently distribute the loads applied to the floor 521 to the wire gauze 524.

In addition, position of the hole-in anchors 525 for fixation of the wire gauze 524 onto a lower surface of a concrete made construction is calculated out in the above mentioned conventional methods. Thus, the hole-in anchors 525 may be got out of position when the wire gauze 524 is actually positioned.

SUMMARY OF THE INVENTION

In view of the above mentioned problems of the prior art, it is an object of the present invention to improve the conventional methods to thereby ensure the fixation of a reinforcement member. It is also an object of the present invention to provide a method of reinforcing a concrete made bridge and a fixture to be used in such a method. It is further an object of the present invention to provide a reinforcement member which is capable of easily being fixed, does not need milch of covering material, and provides excellent reinforcement effects.

In one aspect, the present invention provides a method of reinforcing a concrete made construction including the steps of provisionally disposing a reinforcement member onto a lower surface of a concrete made construction, forming holes at the lower surface of a concrete made construction, and inserting fixtures into the holes to fixate the reinforcement member onto the lower surface of a concrete made construction so that the fixture imparts tension force to the reinforcement member in a plane of the reinforcement member.

The method may preferably include the step of surface-treating the lower surface of a concrete made construction with high-pressure water-washing surface preparation or sand blast before the reinforcement member is fixated onto the lower surface of a concrete made construction.

For instance, a concrete made construction is a bridge.

By fixing the reinforcement member to a concrete made construction with tension force being imparted to the reinforcement member in a plane thereof, there is introduced so-called pre-stress into the reinforcement member. Thus, even if a concrete made construction to which the reinforcement member is secured is deflected, the reinforcement member moves following the deflection of the concrete made construction such as a bridge, thereby a gap being never generated between the reinforcement member and a fixture.

In addition, it is possible to insert fixtures into a concrete made construction with higher accuracy by forming holes to which the fixtures are to be inserted, with a reinforcement member being provisionally secured to a concrete made construction relative to a conventional method in which holes to which fixtures are to be inserted are formed at positions determined by calculation. Thus, the insertion of fixtures ensures introduction of pre-stress to a reinforcement member.

When a mesh-type reinforcing steel is to be used as the reinforcement member, it is preferable to form a covering layer by applying covering material onto the reinforcement member after the reinforcement member has been fixed with a fixture such as the above mentioned one, in order to avoid the reinforcing steels from being exposed to atmosphere and hence prevent the reinforcing steels from being rusted. The covering material of which the layer is made may include polymer cement mortar providing superior adhesion to a surface of a concrete made construction. The layer can be formed, for instance, by direct application of polymer cement mortar to a concrete made construction, positioning a frame onto a surface of a concrete made construction and introducing polymer cement mortar into the frame, or spraying polymer cement mortar to a surface of a concrete cement mortar.

It is preferable to construct the above mentioned covering layer of a multi-layer structure including a base application layer applied onto a lower surface of a concrete made construction, an intermediate application layer lying over the base application layer so that the intermediate layer covers a mesh-type reinforcing steel to be laid onto the base application layer , and an upper application layer lying over the intermediate application layer. The base application layer increases the strength of a lower surface of a concrete made construction, enhances corrosion prevention effect of reinforcing steels embedded in a concrete made construction, and increases adhesive force between reinforcing steels and a concrete made construction. The intermediate application layer provides rust prevention effect to the mesh-type reinforcing steel and decreases salt damage of the mesh-type reinforcing steel. The upper application layer provides neutralization prevention effect, salt damage prevention effect, alkali-aggregate reaction prevention effect and low waterpermeability effect.

Specifically, it is preferable to use FK-A (base application) commercially available from Kyouryo Hozen Inc. for the base application layer, FK-A (intermediate application) for the intermediate application layer, and FK-A (upper application) for the upper application layer.

As a reinforcement member, there may be used a mesh-type reinforcing steel formed by welding steels in a grid or a grating member made of fiber-reinforced resin. The fiber-reinforced resin includes continuous fibers such as glass fibers, carbon fibers and aramide fibers. It is preferable to use as a resin vinyl ester having superior chemical resistance.

A grating member made of fiber-reinforced resin is available from Nefcom K. K. under the trade mark of "Nefcom". Nefcom is composed of resin impregnated continuous fibers such as carbon fibers, glass fibers and aramide fibers formed in a grid having a pitch of 50 mm, 100 mm or 150 mm. Nefcom has a specific gravity in the range of 1.3 to 1.7, which is about ¼ to ⅙ of a specific gravity of steel, almost the same tensile strength as that of a PC steel stranded wire, which is four to five times greater than steel, a tensile elastic modulus which is about ⅔ to ¼ of that of steel, and a band of elastic deformation which is two to five times greater than that of a PC steel stranded wire. In addition, intersections formed by intersecting of gratings has a laminated structure formed by alternately depositing fibers, thereby providing great bonding force. It ensures sufficient strength for imparting tension force to the intersections by means of a fixture. Furthermore, since the intersections lie in a plane unlike a reinforcing steel, it is possible to make strand thin.

The reinforcement member made of fiber-reinforced resin is able to be readily fixed onto a lower surface of a concrete made bridge because of its light weight. In addition, since the reinforcement member made of fiber-reinforced resin has smaller surface hardness than steel, even if a handy drill is accidentally made to contact the reinforcement member, the reinforcement member is merely shaved slightly at a surface thereof. The reinforcement member is never got out of position unlike a reinforcing steel.

In addition, since the fiber-reinforced resin has a band of elastic deformation which is two to five times greater than that of a PC steel stranded wire, it is possible to impart higher tension force to the reinforcement member in a plane thereof without plastic deformation than a reinforcing steel. Thus, it is possible to enhance fixation of the reinforcement member to a concrete made construction.

There may be used a reinforcement member to be fixed onto a lower surface of a concrete made construction by means of a fixture to reinforce the concrete made construction, which reinforcement member includes tension a force imparting device for fixing the reinforcement member onto the lower surface of a concrete made construction with tension force being applied to the reinforcement member by means of the fixture. The tension force imparting device is integral with a main body of the reinforcement member. The tension force imparting device makes it easy to fix the reinforcement member onto a lower surface of a concrete made construction.

In another aspect, the present invention provides a combination of a fixture and a reinforcement member both of which are to be used in a method of reinforcing a concrete made construction including the step of fixing a reinforcement member onto a lower surface of a concrete made construction with tension force being applied to the reinforcement member in a plane thereof by means of a fixture, the reinforcement member being formed with an inclined guide surface for imparting tension force to the reinforcement member, the fixture including an aid a part of which makes contact with the inclined guide surface of the reinforcement member when the fixture is inserted into a concrete made construction, to impart tension force to the reinforcement member in a plane thereof.

By inserting the fixture into a concrete made construction, the aid is moved along the inclined guide surface formed with the reinforcement member, thereby the reinforcement member being fixed onto a lower surface of a concrete made construction with tension force being applied to the reinforcement member in a plane thereof.

In a preferred embodiment, the reinforcement member is comprised of a mesh-type reinforcing steel formed by welding steels in a grid or a grating member made of fiber-reinforced resin.

In another preferred embodiment, the reinforcement member includes vertically extending portions and horizontally extending portions both of which lie in a common plane.

There may be used a fixture including an insertion portion to be inserted into a concrete made construction, an arc-shaped head portion, a tapered portion connecting the insertion portion to the head portion and having a cross-sectional area increasing from the insertion portion towards the head portion, and a resin layer covering said tapered portion therewith. By inserting the above mentioned fixture into a concrete made construction along an intersection of a mesh-type reinforcing steel, the mesh-type reinforcing steel in contact with the fixture is made to externally move along a surface of the tapered portion to thereby impart the tension force to the mesh-type reinforcing steel in a direction of a plane of the mesh-type reinforcing steel.

The resin layer covering the tapered portion therewith provides advantageous effects in particular when fiber-reinforced resin is used as a reinforcement member. The resin layer prevents intersections of a reinforcement member made of fiber-reinforced resin from being damaged on insertion of a fixture keeping in contact with intersections of a reinforcement member, and reduces friction with intersections to thereby enhance insertion efficiency.

There may be used a fixture including a device for applying tension force to a reinforcement member in a plane thereof by moving at least a part of the fixture in a direction perpendicular to a reinforcement member.

There may be used a fixture to be used for fixing a reinforcement member onto a lower surface of a concrete made construction, the fixture including a main body, a support member for fixing the main body to a concrete made construction, and a device for imparting tension force to the reinforcement member in a plane thereof by deformation of the main body caused by pressurizing at least a part of the main body.

For instance, the device for applying tension force includes a shaft to be fixed to a concrete made construction, and a main body having an inclined guide surface for applying tension force therewith. The inclined guide surface imparts tension force to the reinforcement member in a plane thereof as the main body moves along the shaft.

For another instance, the device imparts tension force to a reinforcement member in a plane thereof by rotating at least a part of the fixture.

As an alternative, the device for imparting tension force to a reinforcement member includes a shaft to be fixed to a concrete made construction, and a main body having the form of an eccentric cam and rotatably secured to the shaft.

The device may be designed to have a support member to be fixed to a concrete made construction and a screw being secured to the support member.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
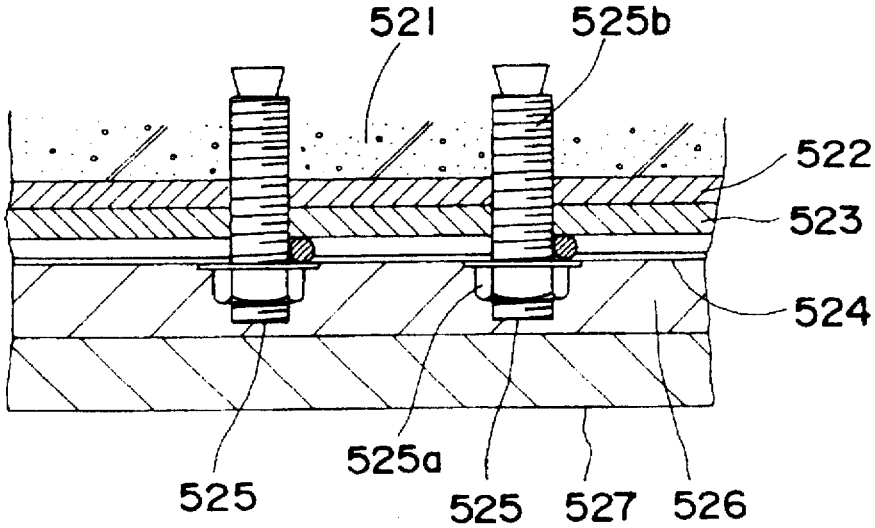
FIG. 1 PRIOR ART
FIG. 1 is a cross-sectional view illustrating a concrete made construction reinforced by a conventional method.
Figure 2:
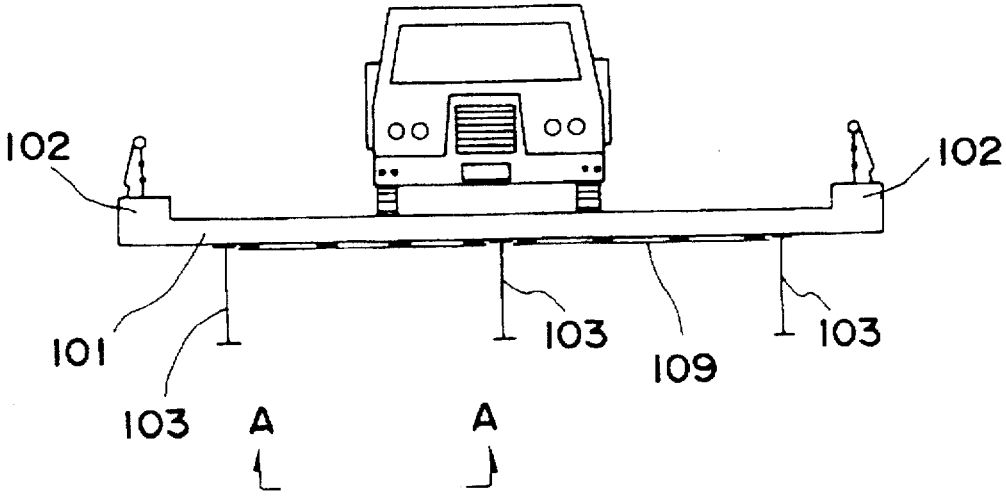
FIG. 2 is a front view illustrating a bridge to which the present invention is applied.

With reference to FIG. 2 illustrating a concrete made bridge to which the present invention is applied, a concrete floor 101 of the bridge is reinforced with steels and is formed at opposite edges thereof with raised portions 102. The floor 101 is supported at a lower surface thereof with three pillars 103. A lower surface of the floor 101 is entirely covered with a covering layer 109 made in accordance with an embodiment, of the present invention.

Figure 3A:
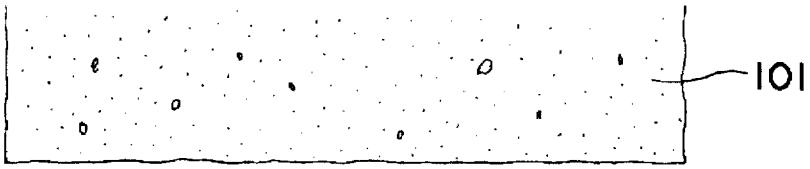
FIGS. 3A to 3G are cross-sectional views showing respective step of the method of reinforcing a concrete made construction.

Hereinbelow is explained a method of forming the covering layer 109 with reference to FIGS. 3A to 3G. As illustrated in FIG. 3A, deteriorated portions are removed from a lower surface of the floor 101 by means of water sand blast. Then, the lower surface is washed by high-pressure water-washing surface preparation in which jet water having a pressure of 200 kgf/cm$^2$ or greater is used.

Figure 3B:
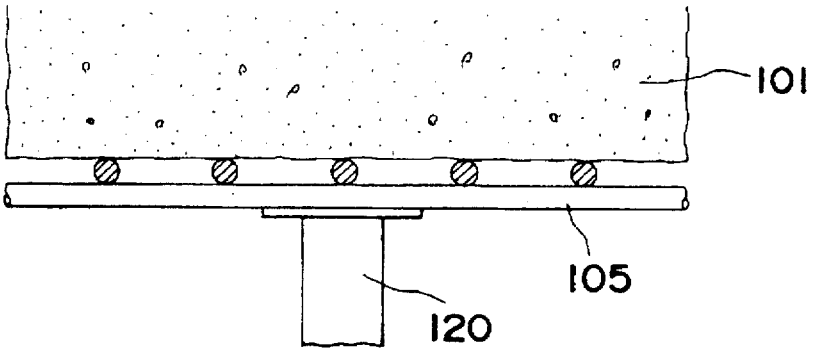

Then, as illustrated in FIG. 3B, a mesh-type reinforcing steel 105 is provisionally supported by a support 120 onto the lower surface of the floor 101. The mesh-type reinforcing steel 105 is formed by arranging steels having a diameter in the range of 6 mm to 10 mm into a mesh having an area in the range of 1.8×3 to 1.8×4 m$^2$, and welding intersections of the thus arranged steels.

Figure 3C:
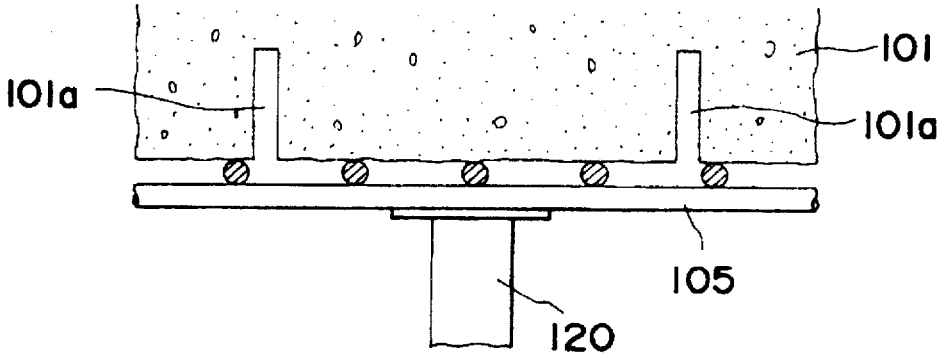

Then, as illustrated in FIG. 3C, holes 10*a* are formed at the lower surface of the floor 101 at the intersections of the mesh-type reinforcing steel 105. As mentioned later, a fixture is to be inserted into each of the holes 101*a*. It is possible to insert fixtures in to a concrete made construction with higher accuracy by forming the holes 101*a* with the mesh-type reinforcing steel 105 being provisionally secured to a lower surface of a concrete made construction relative to a conventional method in which holes to which fixtures are to be inserted are formed at positions determined by calculation.

Figure 3D:
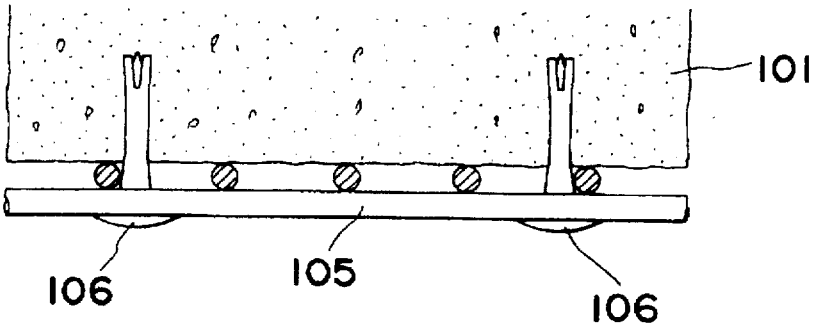

Then, as illustrated in FIG. 3D, fixtures 106 are inserted and driven into the holes 101*a* by means of a vibration hammer to thereby fix the mesh-type reinforcing steel 105 onto the lower surface of the concrete floor 101.

Figure 4:
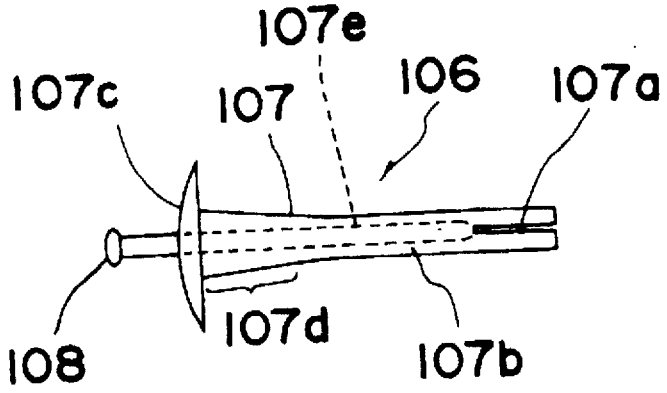
FIG. 4 is a plan view illustrating a fixture made in accordance with the present invention.

FIG. 4 illustrates the fixture 106. The fixture 106 is comprised of an anchor 107 and a pin 108. The anchor 107 includes a rod-shaped insertion portion 107*b* to be inserted into a concrete made construction, which insertion portion 107*b* is formed at a distal end thereof with an expanding slot 107*a*, an arc-shaped head portion 107*c*, and a tapered portion 107*d* connecting the insertion portion 107*b* to the head portion 107*c* and having a cross-sectional area increasing from the insertion portion 107*b* towards the head portion 107*c*. There is formed a through hole 107*e* axially extending through the anchor 107. The pin 108 is to be inserted into a concrete made construction through the through hole 107*e*. By forming the head portion 107*c* of the anchor 107 to be arc-shaped, it is possible to decrease the projecting length of the fixture 106 from a lower surface of the floor 101, and thus an amount of covering material to be applied to a lower surface of the floor 101 can be decreased by about 40% relative to a conventional hexagonal-shaped bolt.

The size is dependent on a diameter of reinforcing steel constituting the mesh-type reinforcing steel 105. However, it is preferable that the insertion portion 107*b* has a diameter in the range of 6 mm to 8 mm, and the tapered portion 107*d* has a diameter in the range of 2 mm to 3 mm.

Figure 5:
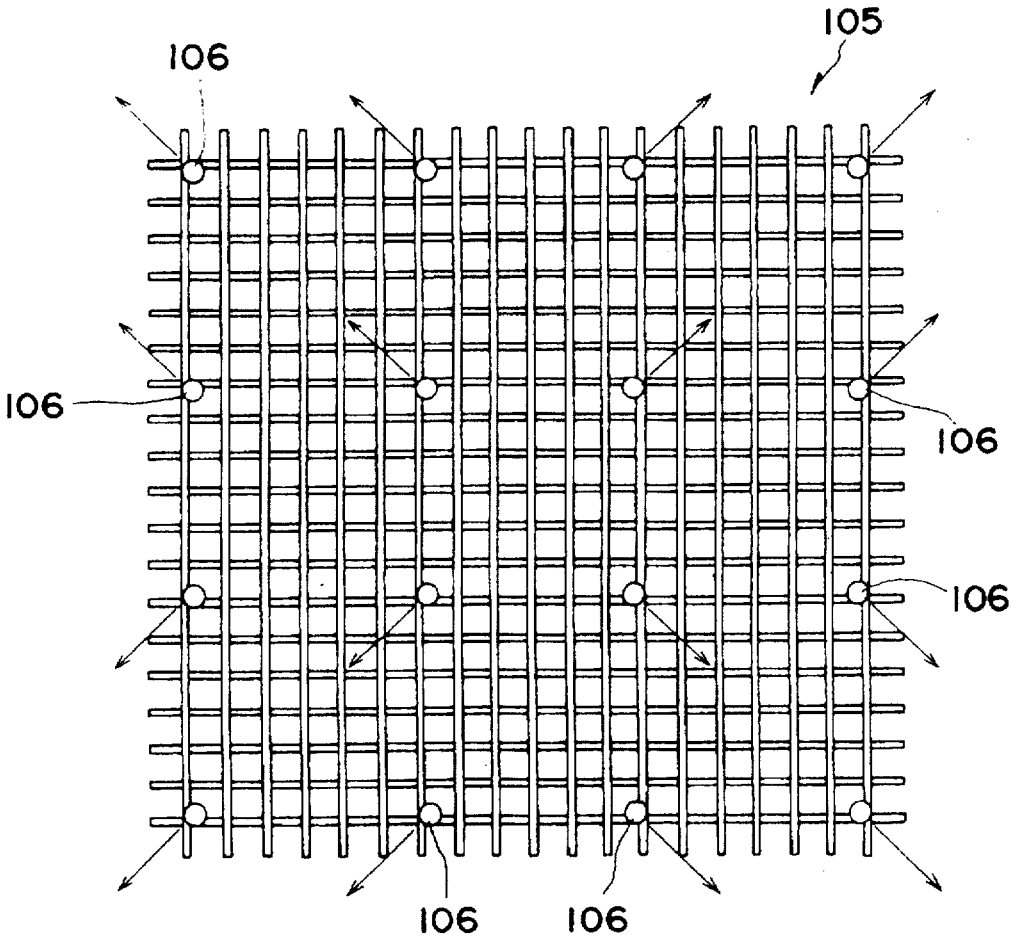
FIG. 5 is an enlarged view as viewed in a direction indicated with an arrow A shown in FIG. 2.

By inserting the fixture 106 into the concrete made floor 101, the tapered portion 107*d* having a cross-sectional area increasing towards the head portion 107*c* ensures that the tension force is imparted entirely to the mesh-type reinforcing steel 105 in a plane thereof in a direction indicated with arrows in FIG. 5. The tapered portion 107*d* additionally ensures the fixation of the mesh-type reinforcing steel 105 onto the floor 101 even when the holes 101*a* are formed out of position or intersections of the mesh-type reinforcing steel 105 are disposed out of position. In the illustrated embodiment, the tension force is directed to outside from a span center of the floor 101, that is, a point at which the concrete made construction has a maximum deflection caused by loads to be applied thereto and its own weight.

Figure 3E:
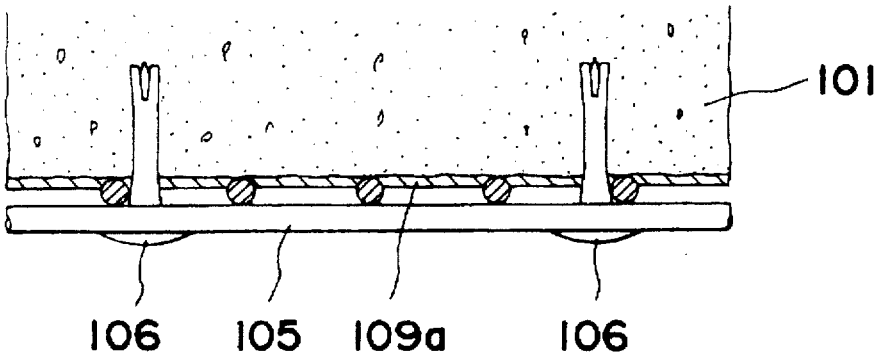
Figure 3F:
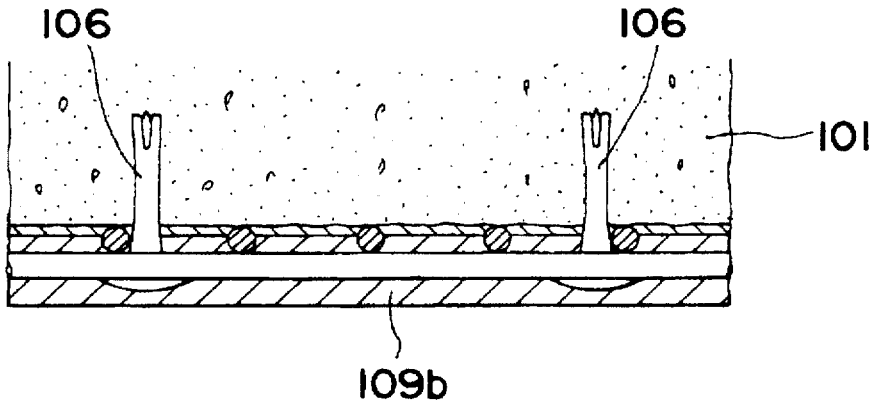
Figure 3G:
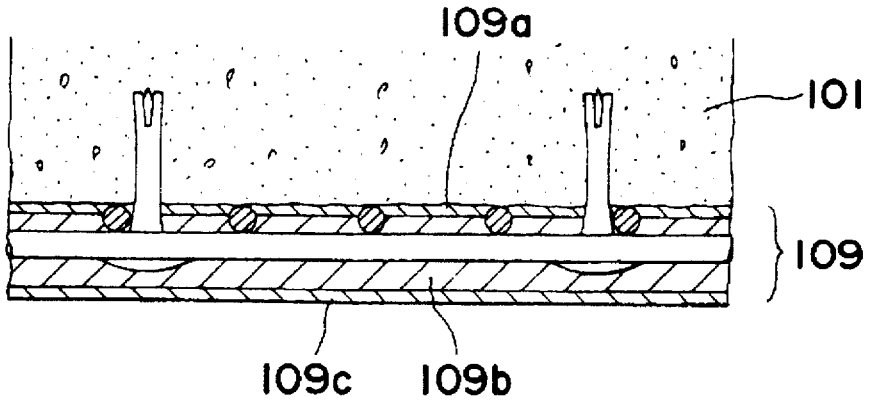

Then, as illustrated in FIGS. 3E to 3G, there is formed a covering layer 109. The covering layer 109 includes a base application layer 109*a* (see FIG. 3E) applied onto the lower surface of the floor 101, an intermediate application layer 109*b* (see FIG. 3F) lying over the base application layer 109*a* so that the intermediate layer 109*b* covers the mesh-type reinforcing steel 105 to be laid onto the base application layer 109*a*, and an upper application layer 109*c* (see FIG. 3G) lying over the intermediate application layer 109*b*. The base application layer 109*a* increases the strength of the lower surface of the floor 101, enhances corrosion prevention effect of reinforcing steels embedded in the floor 101, and increases adhesive force between the reinforcing steels and the floor 101. The intermediate application layer 109*b* provides rust prevention effect to the mesh-type reinforcing steel 105 and decreases salt damage of the mesh-type reinforcing steel 105. The upper application layer 109*c* provides neutralization prevention effect, salt damage prevention effect, alkali-aggregate reaction prevention effect and low water-permeability effect. The base application layer 109*a* is applied by spraying, and the intermediate application layer 109*b* and the upper application layer 109*c* are formed by direct application onto the base application layer 109*a*.

Figure 6:
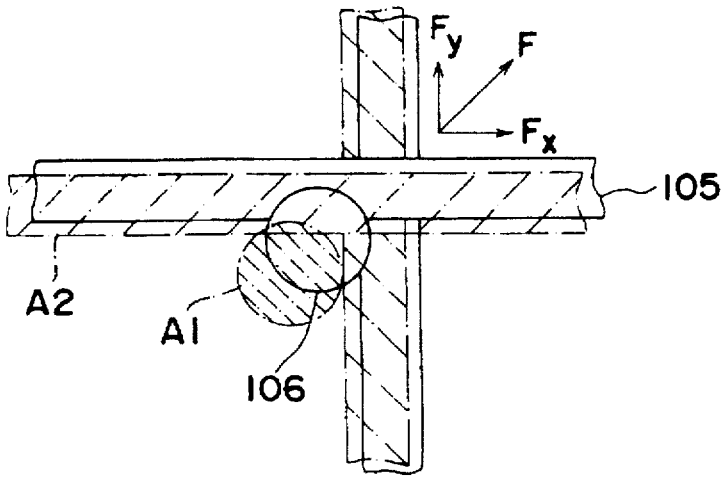
FIG. 6 illustrates behavior of a mesh-type reinforcing steel and a fixture made in accordance with the present invention, caused by deflection of a floor of a concrete made construction.

FIG. 6 illustrates behavior of the mesh-type reinforcing steel 105 and the fixture 106 caused by deflection of the floor 101 after the above mentioned mending has been completed. As illustrated, the fixture 106 imparts the tension force F to the intersection of the mesh-type reinforcing steel 105 in a direction indicated with an arrow. Thus, the mesh-type reinforcing steel 105 is given prestresses Fx and Fy in x- and y-axes, respectively. Thus, when the fixture 106 is caused to move by the deflection of the floor 101 as shown with an alternate long and short dash line A1, the mesh-type reinforcing steel 105 follows the fixture 106 as shown with an alternate long and short dash line A2, thereby a gap being not produced between the mesh-type reinforcing steel 105 and the fixture 106 unlike the prior method.

A test was conducted to confirm the advantageous effects of the invention. A reinforcing steel of a concrete made construction had the tensile stress intensity of 20 tons, whereas a reinforcing steel reinforced in accordance with the present invention had 0.3 times greater stress intensity than the stress intensity of a reinforcing steel to which the present invention is not applied. Namely, there was obtained 70% reduction in tensile stress. Thus, it was confirmed that the method of the present invention prevents cracking of a floor of a construction such as a bridge, and hence keeps effective area of concrete unchanged, thereby preventing degradation of a floor caused by shearing and fatigue failure as well as bending.

It should be noted that the method of the present invention is not to be limited to the mending of damaged concrete made construction. For instance, it is possible to use the present invention for increasing the strength of a bridge up to 25 tons which bridge is originally designed to have the strength of 20 tons. In addition, the present invention can be applied also to reinforcement of a lower surface of a beam or pillar. In particular, it is most effective to apply the invention to a floor or beam which is repeatedly deflected by vehicles running thereon when a floor or beam is being mended.

By fixing the mesh-type reinforcing steel to a concrete made construction with the tension force being imparted to the mesh-type reinforcing steel in a plane thereof, there is introduced pre-stress into the mesh-type reinforcing steel. Thus, even if a concrete made construction to which the mesh-type reinforcing steel is secured is deflected, the mesh-type reinforcing steel moves following the deflection of the concrete made construction, thereby a gap being never generated between the mesh-type reinforcing steel and the fixture. Hence, the fixation of the mesh-type reinforcing steel to a concrete made construction can be enhanced, and thereby it is possible to maintain the reinforcing effect in a long time.

In addition, the present invention ensures the fixation of the mesh-type reinforcing steel, in particular, to a floor of a bridge which is deflected during the method is being carried out for reinforcing the floor.

Furthermore, it is possible to insert the fixtures into a concrete made construction with higher accuracy by forming the holes to which the fixtures are to be inserted, with the mesh-type reinforcing steel being provisionally secured to a concrete made construction relative to a conventional method in which holes to which fixtures are to be inserted are formed in advance. Thus, the insertion of the fixtures ensures introduction of pre-stress to the mesh-type reinforcing steel.

Hereinbelow will be described the method of reinforcing a concrete made construction by using a reinforcement member made of fiber-reinforced resin.

Figure 7A:
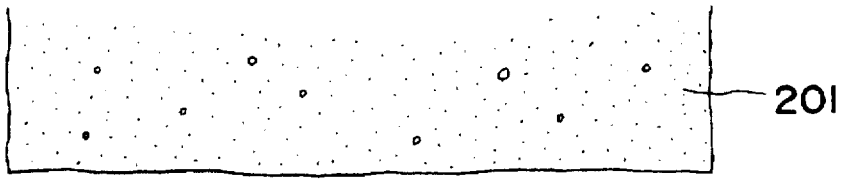
FIGS. 7A to 7G are cross-sectional views showing respective step of the method of reinforcing a concrete made construction.

As illustrated in FIG. 7A, deteriorated portions are removed from a lower surface of a concrete made floor 201 by means of water sand blast. Then, the lower surface is washed by high-pressure water-washing surface preparation in which jet water having a pressure of 200 kgf/cm$^2$ or greater is used.

Figure 7B:
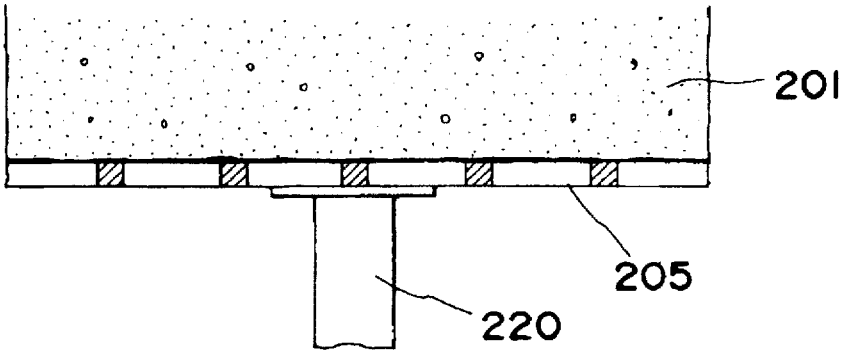

Then, as illustrated in FIG. 7B, a reinforcement member 205 is provisionally supported by a support 220 onto the lower surface of the floor 201. The reinforcement member 205 is formed by arranging fiber-reinforced resin in a grid having an area in the range of 1.8×3 to 1.8×4 m$^2$.

Figure 8:
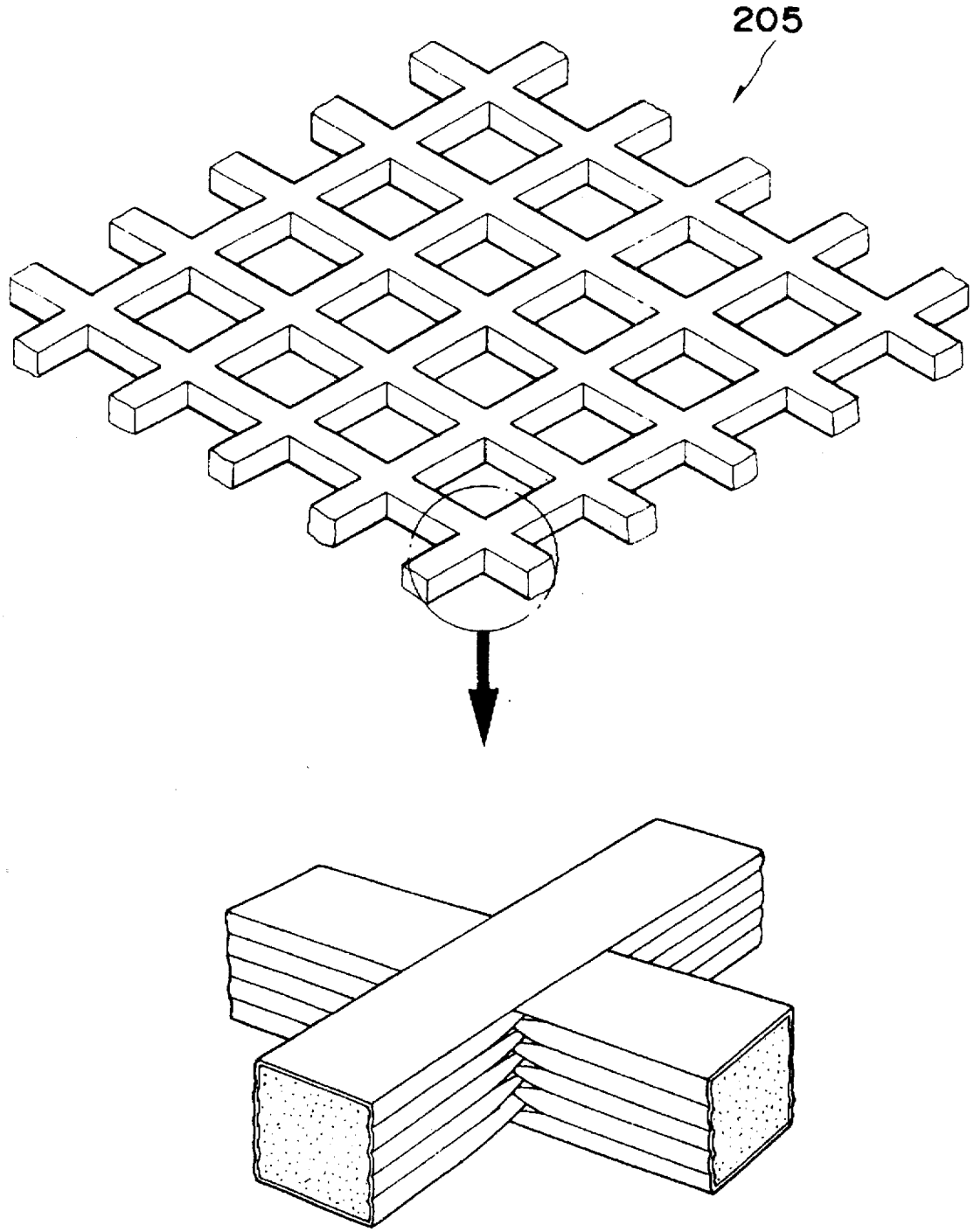
FIG. 8 is a perspective view illustrating a reinforcement member.

FIG. 8 is a perspective view illustrating the reinforcement member 205. As a fiber is used a continuous fiber such as a glass fiber, carbon fiber or aramide fiber, and as a resin is used vinyl ester having superior chemical resistance. The reinforcement member 205 has a specific gravity in the range of 1.3 to 1.7, tensile strength four to five times greater than that of a reinforcing steel, tensile elastic modulus which is about ⅔ to ¼ of that of steel, and a band of elastic deformation which is two to five times greater than that of a PC steel stranded wire. In addition, as illustrated in an enlarged view in FIG. 8, since intersections are formed by alternately depositing fibers, it is possible to provide adequate strength due to adhesive strength of resin and bonding effects among fibers. Furthermore, since the intersections lie in a plane unlike a reinforcing steel, it is possible to make strand thin.

Figure 7C:
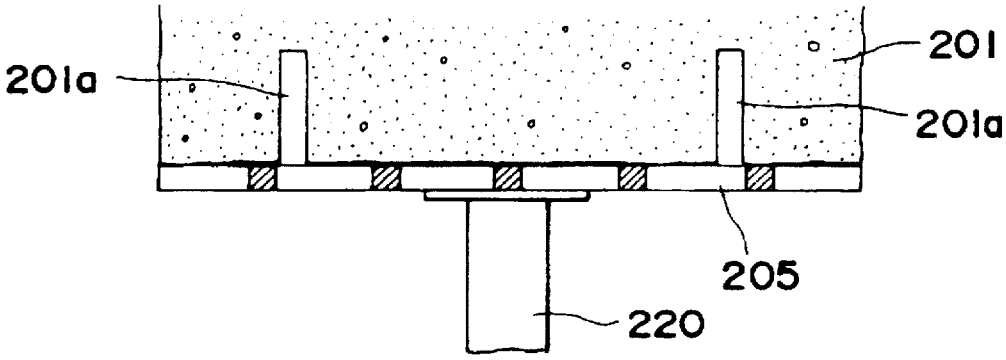

Turning back to FIG. 7C, holes 201*a* are formed at the lower surface of the floor 201 at the intersections of the reinforcement member 205 with a drill. As mentioned later, a fixture is to be inserted into each of the holes 201*a*. It is possible to insert fixtures into a concrete made construction with higher accuracy by forming the holes 201*a* with the reinforcement member 205 being provisionally secured to a lower surface of a concrete made construction relative to a conventional method in which holes to which fixtures are to be inserted are formed at positions in advance.

Figure 7D:
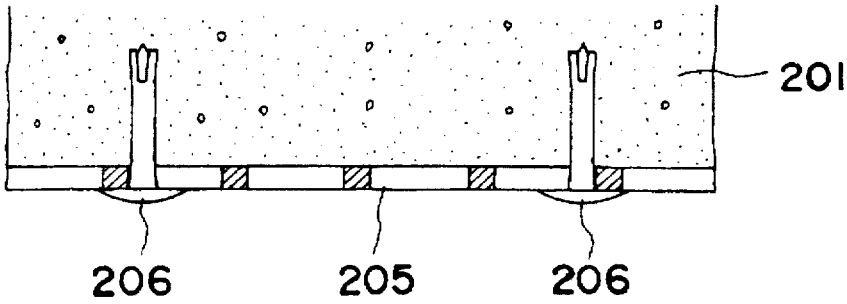

Then, as illustrated in FIG. 7D, fixtures 206 are inserted and driven into the holes 201*a* by means of a vibration hammer to thereby fix the reinforcement member 205 onto the lower surface of the concrete floor 201.

Figure 9:
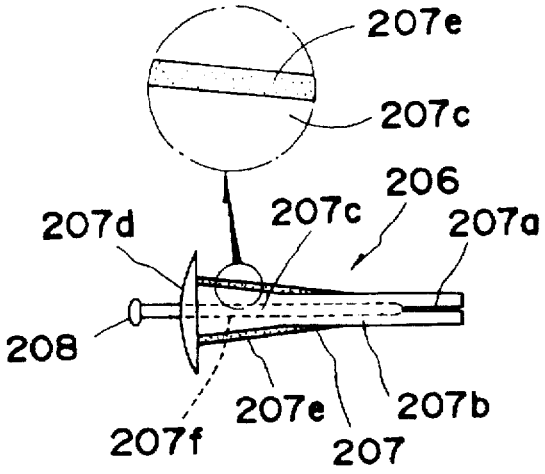
FIG. 9 is a plan view of a fixture made in accordance with the present invention.

FIG. 9 illustrates the fixture 206. The fixture 206 is comprised of an anchor 207 and a pin 208. The anchor 207 includes a rod-shaped insertion portion 207*b* to be inserted into a concrete made construction, which insertion portion 207*b* is formed at a distal end thereof with an expanding slot 207*a*, an arc-shaped head portion 207*d*, and a tapered portion 207*c* connecting the insertion portion 207*b* to the head portion 207*d* and having a cross-sectional, area increasing from the insertion portion 207*b* towards the head portion 207*d*. There is formed a through hole 207*f* axially extending through the anchor 207. The pin 208 is to be inserted into a concrete made construction through the through hole 207*f*. Around the tapered portion 207*c* is formed a resin layer 207*e* made of vinyl ester. The resin layer 207*e* covering the tapered portion 207*c* prevents intersections of the reinforcement member 205 made of fiber-reinforced resin from being damaged on insertion of the fixtures 206 keeping in contact with intersections of the reinforcement member 205, and reduces friction with the intersections of the reinforcement member 205 to thereby enhance insertion efficiency.

The size of the fixture 206 is dependent on the size of grid of the reinforcement member 205, however, it is preferable that the insertion portion 207*b* has a diameter in the range of 6 to 8 cm, and the tapered portion 207*c* has a diameter in the range of 2 to 3 cm.

Figure 10:
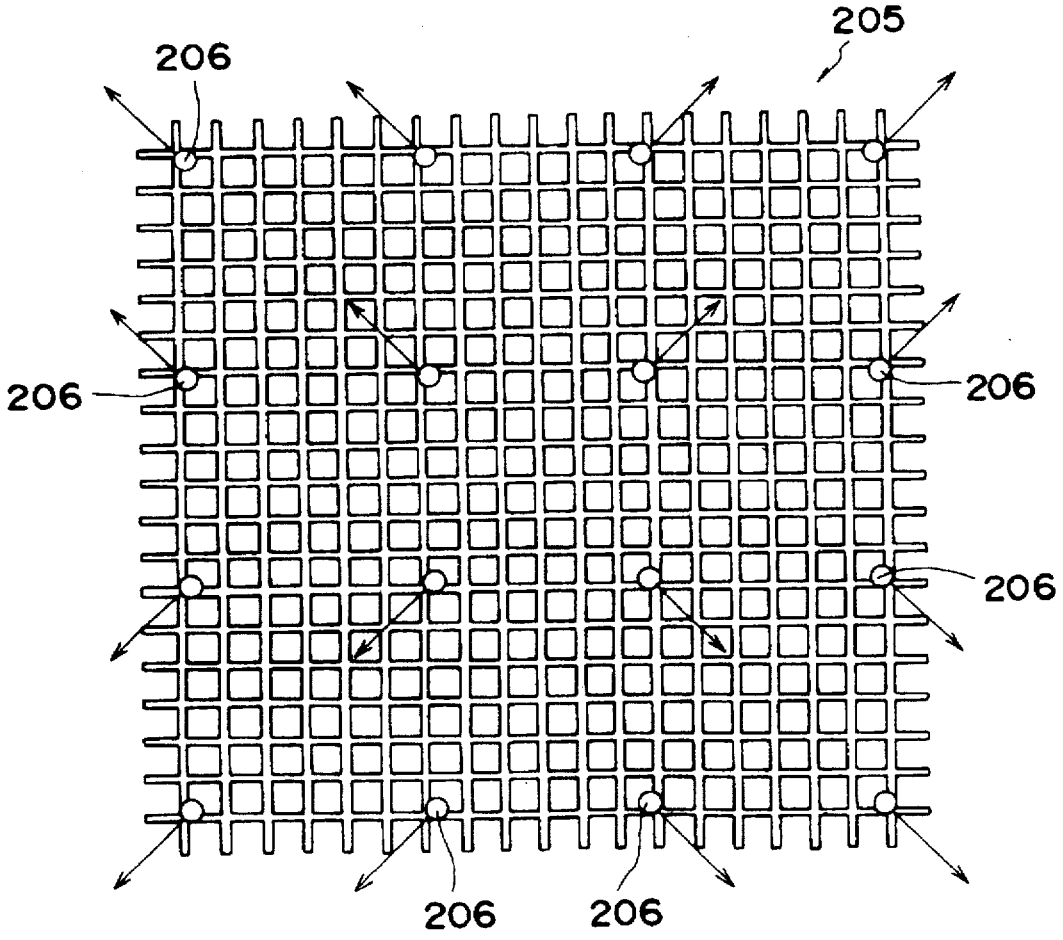
FIG. 10 is a plan view illustrating a reinforcement member.

By inserting the fixture 206 into the concrete made floor 201, the tapered portion 207*c* ensures by wedge-function thereof that the tension force is imparted entirely to the reinforcement member 205 in a plane thereof in a direction indicated with arrows in FIG. 10. The tapered portion 207*c* additionally ensures the fixation of the reinforcement member 205 onto the floor 201 even when the holes 201*a* are formed out of position or intersections of the reinforcement member 205 are disposed out of position. In the illustrated embodiment, the tension force is directed to outside from a span center of the floor 201, that is, a point at which the concrete made construction has a maximum deflection caused by loads to be applied thereto and its own weight.

Figure 7E:
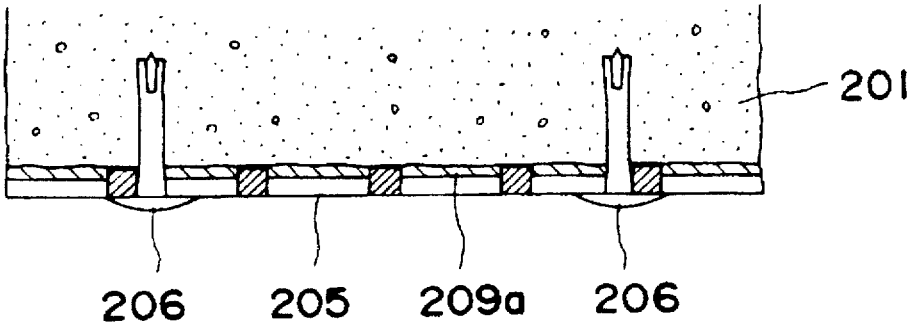
Figure 7F:
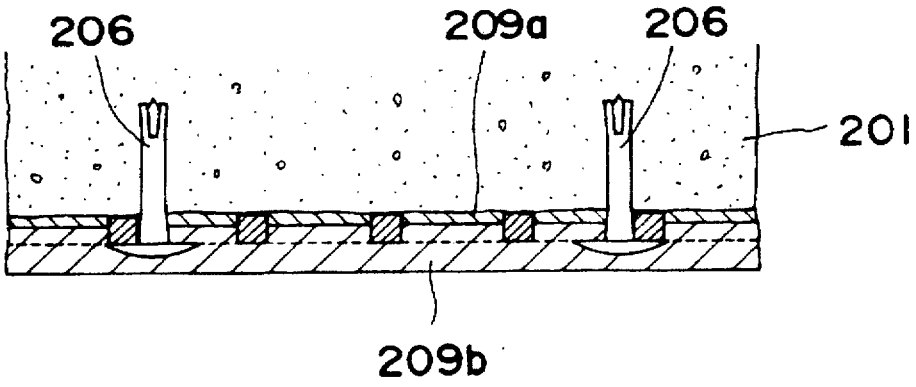
Figure 7G:
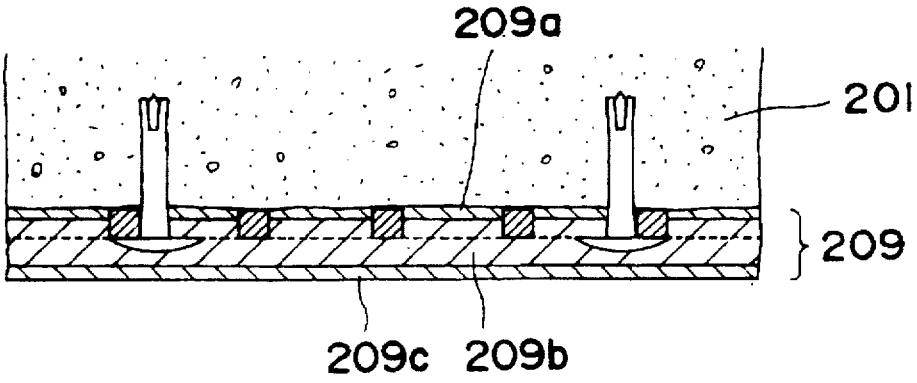

Then, as illustrated in FIGS. 7E to 7G, there is formed a covering layer 09. The covering layer 209 includes a base application layer 209*a* (see FIG. 7E) applied onto the lower surface of the floor 201, an intermediate application layer 209*b* (see FIG. 7F) lying over the base application layer 209*a* so that the intermediate layer 209*b* covers the reinforcement member 205 which is to be laid onto the base application layer 209*a*, and an upper application layer 209*c* (see FIG. 7G) lying over the intermediate application layer 209*b*. The base application layer 209*a* increases the strength of the lower surface of the floor 201, enhances corrosion prevention effect of reinforcing steels embedded in the floor 201, and increases adhesive force between the reinforcing steels and the floor 201. The intermediate application layer 209*b* provides rust prevention effect to the reinforcement member 205 and decreases salt damage of the reinforcement member 205. The upper application layer 209*c* provides neutralization prevention effect, salt damage prevention effect, alkali-aggregate reaction prevention effect and low water-permeability effect. The base application layer 209*a* is applied by spraying, and the intermediate application layer 209*b* and the upper application layer 209*c* are formed by direct application onto the base application layer 209*a*. It should be noted that the formation of the covering layer 209 is not always necessary when the reinforcement member is made of resin like the embodiment.

In the embodiment, the reinforcement member 205 is made of fiber-reinforced resin much lighter in weight than a reinforcing steel, thereby the fixation of the reinforcement member 205 onto a lower surface of a concrete made construction is easier than when a reinforcing steel is to be used as a reinforcement member, and a surface hardness of the reinforcement member 205 is quite smaller than steel. Thus, even if a drill makes accidental contact with the reinforcement member 205, the reinforcement member 205 is merely shaved, and not repelled, which would result in that the reinforcement member 205 is not got out of position unlike a reinforcing steel.

In addition, as mentioned earlier, since the fiber-reinforced resin has a plastic deformation band two to five times greater than a PC steel stranded wire, it is possible to impart higher tension force to the reinforcement member in a plane without plastic deformation of the reinforcement member than a reinforcing steel, which would enhance the fixation of the reinforcement member to a concrete made construction.

Hereinbelow will be described the embodiments of a fixture used for fixing a reinforcement member onto a lower surface of a concrete made construction.

Figure 11:
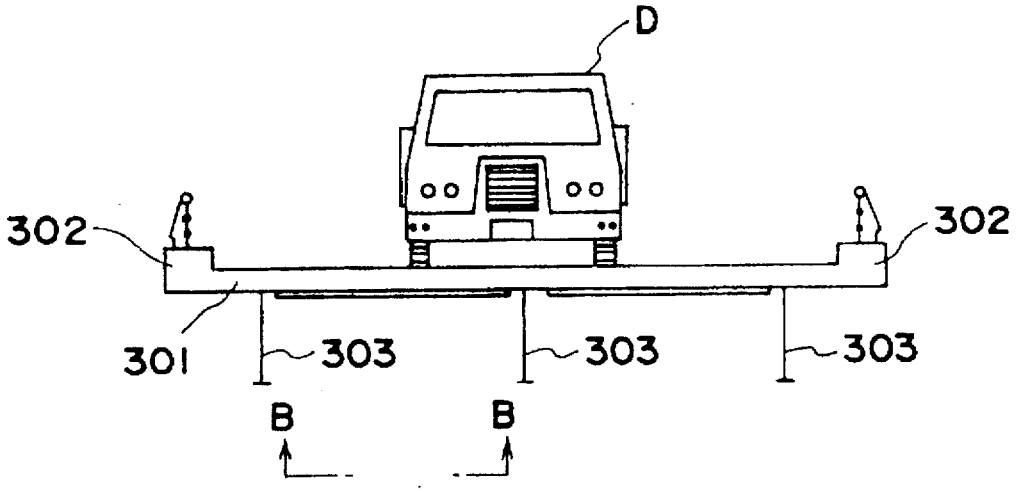
FIG. 11 is a front view illustrating a concrete made bridge reinforced by a fixture made in accordance with the first embodiment.
Figure 12:
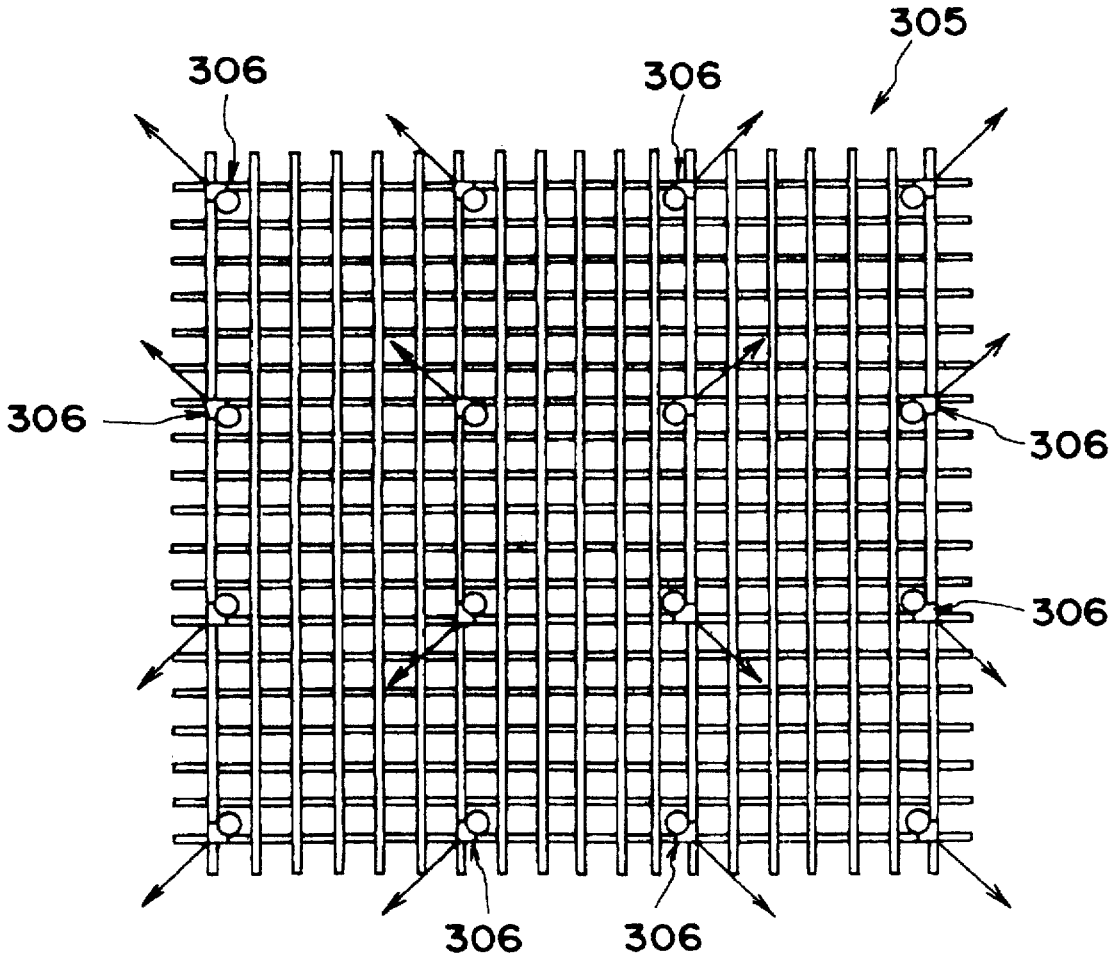
FIG. 12 is an enlarged view as viewed in a direction indicated with an arrow B shown in FIG. 11.

FIG. 11 is a front view illustrating a concrete made bridge reinforced by fixing a grating member 305 onto a lower surface of the bridge by means of a fixture 306 made in accordance with the first embodiment. FIG. 12 is an enlarged view as viewed in a direction indicated with an arrow B shown in FIG. 11, FIG. 13 is an enlarged view of a part of FIG. 12, and FIG. 14 is a cross-sectional view taken along the line C—C in FIG. 13.

As illustrated in FIG. 11, a floor 301 of a concrete made bridge is formed at opposite edges thereof with raised portions 302. The floor 301 is supported at a lower surface thereof with three pillars 303. A truck D as a live load runs on the floor 301.

As illustrated in FIG. 12, the grating member 305 acting as a reinforcement member is fixed entirely onto a lower surface of the floor 301 which is formed by vertically and horizontally arranging reinforcing steels, which has a diameter in the range of 6 to 10 mm, at a predetermined pitch like a mesh and welding intersections of the thus arranged steels. The fixture 306 is set at the intersections of the grating member 305, thereby fixing the grating member 305 onto a lower surface of the floor 301.

Figure 13:
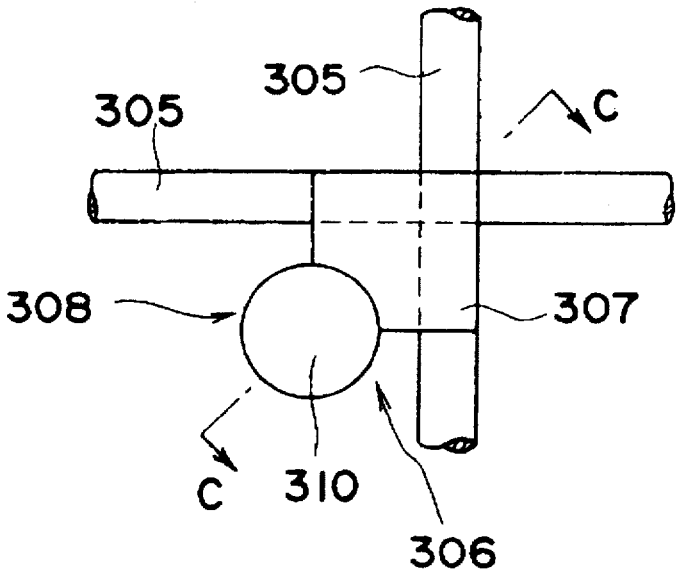
FIG. 13 is an enlarged view of a part of FIG. 12.
Figure 14:
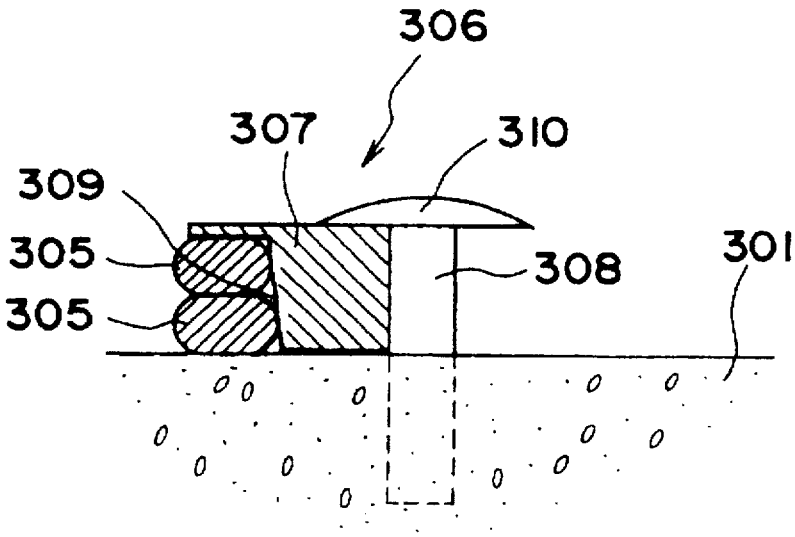
FIG. 14 is a cross-sectional view taken along the line C—C in FIG. 13.

As illustrated in FIGS. 13 and 14, the fixture 306 is comprised of a main body 307 and an anchor 308. The main body 307 is formed with an inclined guide surface 309 which is to make contact with the grating member 305. Accordingly, when the anchor 308 is driven into the floor 301 with the main body 307 being set at an intersection of the grating member 305 and the inclined guide surface 309 making contact with the grating member 305, a head 310 of the anchor 308 causes the main body 307 to move perpendicularly to a plane of the grating member 305. Then, the inclined guide surface 309 making contact with the grating member 305 imparts a force to the grating member 305 in a plane thereof. Thus, as illustrated in FIG. 12, by fixing the grating member 305 onto a lower surface of the floor 301 with a plurality of the fixtures 306 at various positions, the tension force is imparted to the grating member 305 in a direction indicated with arrows.

On the fixation of the grating member 305 onto a lower surface of the floor 301 of a concrete made bridge, the use of the fixture 306 having a tensioning device such as mentioned above ensures that the tension force is entirely imparted to the grating member 305 in a plane thereof. By fixing the grating member 305 onto the lower surface of the floor 301 with the tension force being imparted to the grating member 305, there is introduced pre-stress into the grating member 305. Thus, even if the floor 301 to which the grating member 305 is secured is deflected, the grating member 305 moves following the deflection of the floor 301, thereby the stable fixation between the grating member and the floor 301 being ensured. In the illustrated embodiment the tension force is directed to outside from a span center of the floor 301, that is, a point at which the floor 301 has a maximum deflection caused by loads to be applied thereto and its own weight.

Then, the lower surface of the floor 301 is covered with the covering layer made of polymer cement mortar having a thickness of about 20 mm so that the covering layer entirely covers the fixtures 306 and the grating member 305. Thus, the reinforcement of the floor 301 is completed.

Figure 15:
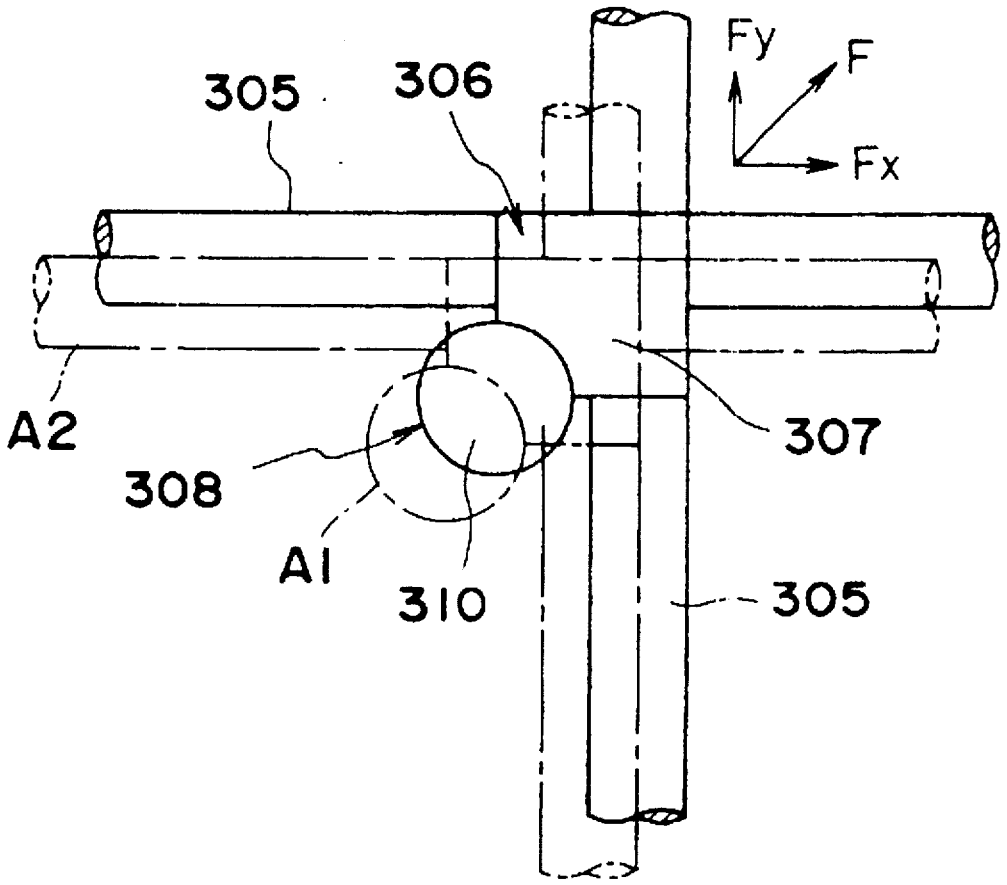
FIG. 15 illustrates behavior of a mesh-type reinforcing steel and a fixture made in accordance with the present invention, caused by deflection of a floor of a concrete made construction.

FIG. 15 illustrates behavior of the grating member 305 and the fixture 306 caused by deflection of the floor 301 after the above mentioned reinforcement has been completed. As illustrated, the fixture 306 imparts the tension force F to the intersection of the grating member 305 in a direction indicated with an arrow. Thus, the grating member 305 is given pre-stresses Fx and Fy in x- and y-axes, respectively. Thus, when the fixture 306 is caused to move by the deflection of the floor 301 as shown with an alternate long and short dash line A1, the grating member 305 follows the fixture 306 as shown with an alternate long and short dash line A2, thereby a gap being not produced between the grating member 305 and the fixture 306 unlike the prior method, and thus the reinforcement effect being kept not reduced.

Figure 16:
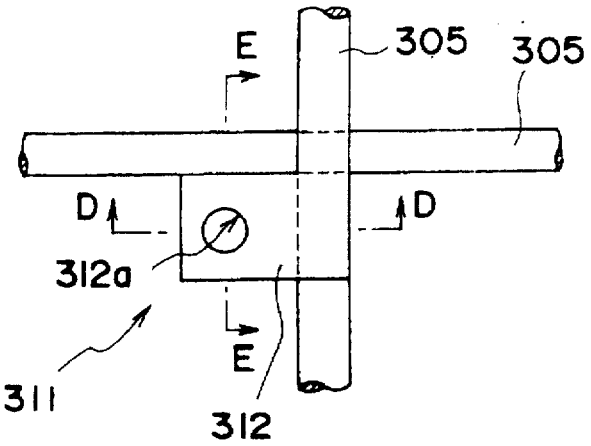
FIG. 16 is a plan view illustrating a grating member fixed with a fixture made in accordance with the second embodiment.

Hereinbelow will be described the second embodiment with reference to FIGS. 16 to 18. FIG. 16 is a plan view illustrating the grating member 305 fixed with a fixture 311, FIG. 17 is a cross-sectional view taken along the line D—D in FIG. 16, and FIG. 18 is a cross-sectional view taken along the line E—E in FIG. 16.

Similarly to the first embodiment, the fixture 311 is set at intersections of the grating member 305, thereby fixing the grating member 305 onto a lower surface of the floor 301 of a concrete made bridge.

Figure 17:
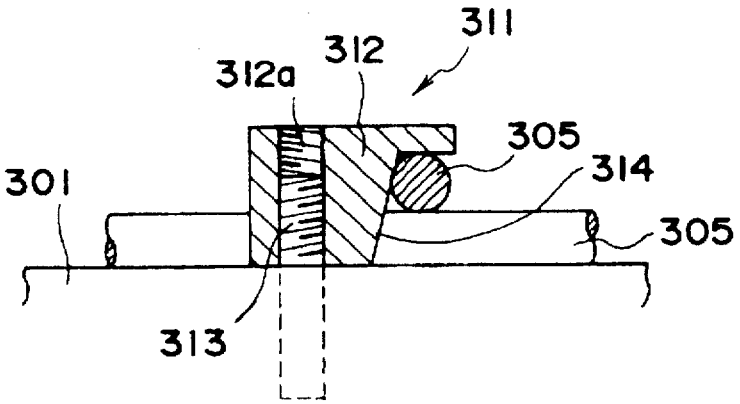
FIG. 17 is a cross-sectional view taken along the line D—D in FIG. 16.
Figure 18:
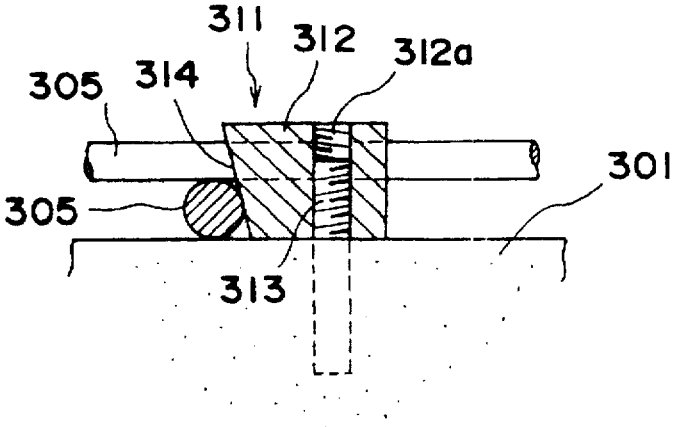
FIG. 18 is a cross-sectional view taken along the line E—E in FIG. 16.

As illustrated in FIGS. 16 to 18, the fixture 311 is comprised of a main body 312 and an anchor 313 threaded into a tapped hole 312*a*. The main body 312 is formed with an inclined guide surface 314 which is to make contact with the grating member 305. Accordingly, when the anchor 313 is driven into the floor 301 at an intersection of the grating member 305 and then the main body 311 is made to move towards the floor 301, the inclined guide surface 314 making in contact with the grating member 305 imparts the tension force to the grating member 305 in a plane thereof. Thus, a plurality of the fixtures 311 disposed at a plurality of intersections of the grating member 305 ensures that the great tension force is entirely imparted to the grating member 305.

Figure 19:
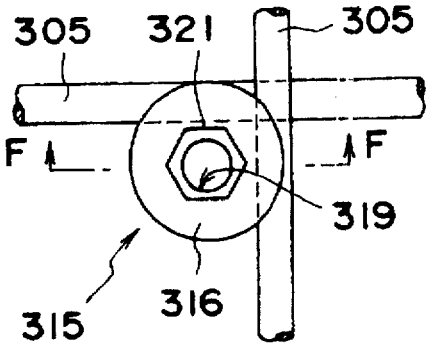
FIG. 19 is a plan view illustrating a grating member fixed with a fixture made in accordance with the third embodiment.
Figure 20:
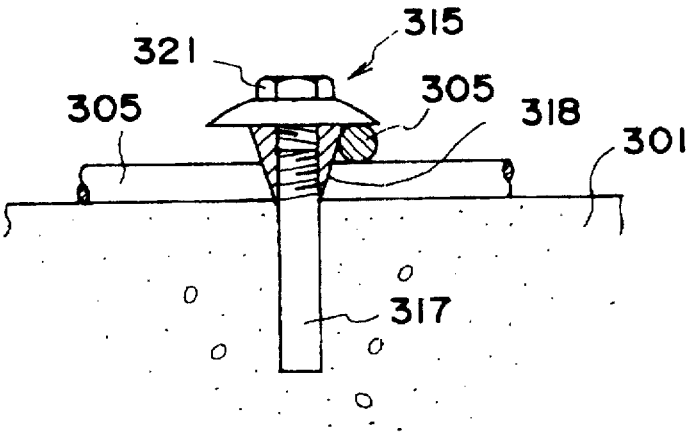
FIG. 20 is a cross-sectional view taken along the line F—F in FIG. 19.

Hereinbelow will be described a fixture made in accordance with the third embodiment with reference to FIGS. 19 to 21. FIG. 19 is a plan view illustrating the grating member 305 fixed with a fixture 315, FIG. 20 is a cross-sectional view taken along the line F—F in FIG. 19, and FIG. 21 is a schematic view of the fixture 315.

Figure 21:
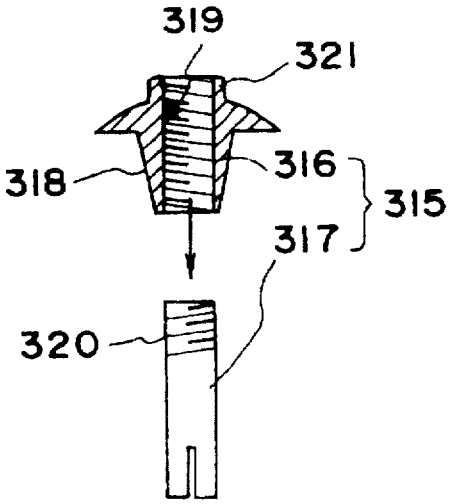
FIG. 21 is a schematic view of a fixture.

As illustrated in FIG. 21, the fixture 315 is comprised of a main body 316 and an anchor 317. The main body 316 is formed with an inclined guide surface 318 which is to make contact with the grating member 305. The main body 316 is formed also with a tapped hole 319 into which a threaded portion 320 of the anchor 317 is engaged. Accordingly, by driving the anchor 317 into the floor 301 at an intersection of the grating member 305, engaging the tapped hole 319 of the main body 316 to the anchor 317, and then gradually rotating the main body 316, the inclined guide surface 318 making contact with the grating member 305 imparts the tension force to the grating member 305 in a plane thereof.

Since the main body 316 is formed at a summit thereof with a nut 321, it is relatively easy to rotate the main body 316 with a tool such as a spanner. In addition, it is possible to control the tension force to be applied to the grating member 305 by controlling rotation angle of the main body 316. Similarly to the second embodiment, a plurality of the fixtures 315 disposed at a plurality of intersections of the grating member 305 ensures that the tension force is entirely imparted to the grating member 305.

Figure 22:
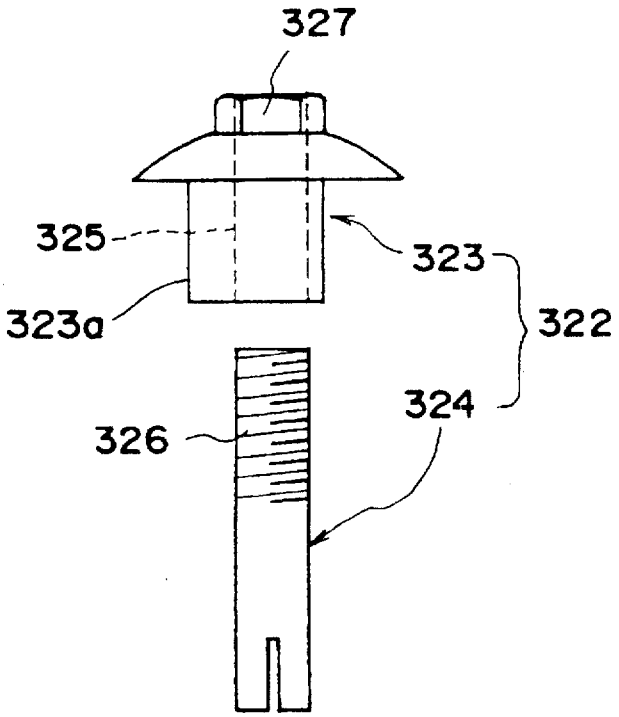
FIG. 22 is a schematic view illustrating a fixture made in accordance with the fourth embodiment.
Figure 23:
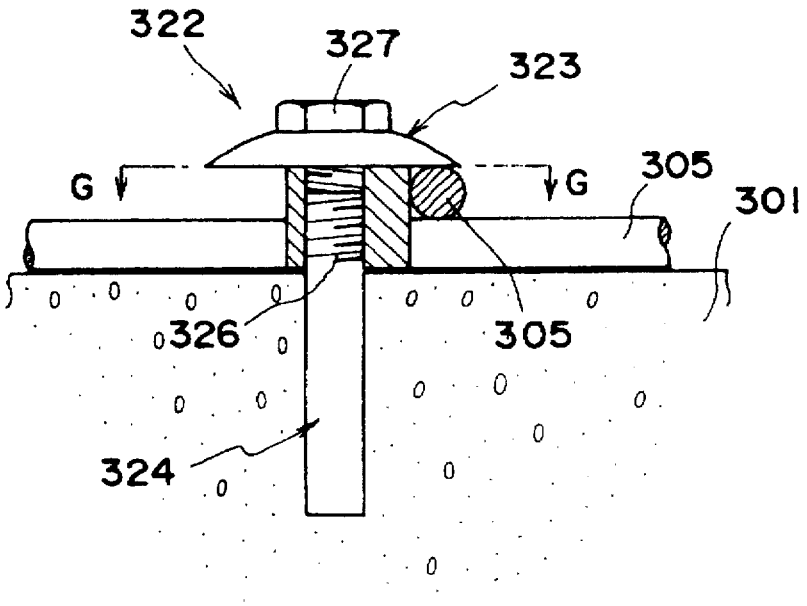
FIG. 23 is a cross-sectional view illustrating a grating member fixed with a fixture.
Figure 24:
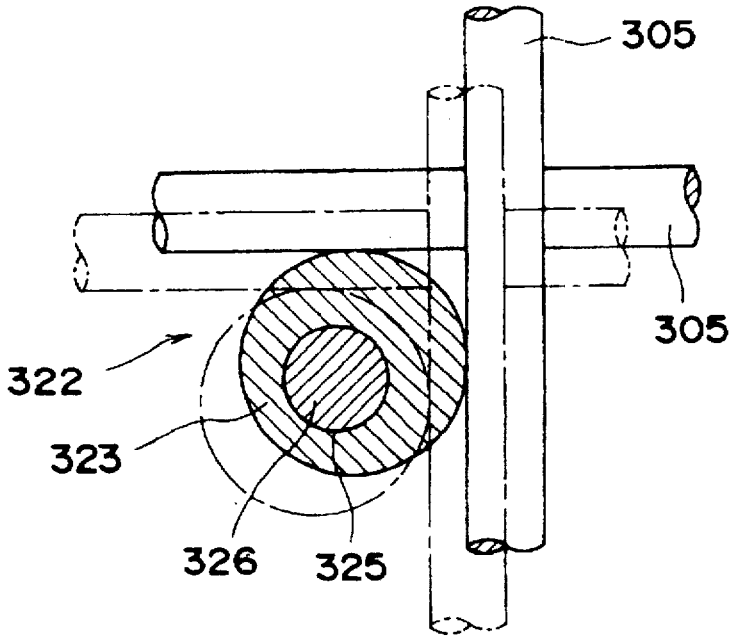
FIG. 24 is a cross-sectional view taken along the line G—G in FIG. 23.

Hereinbelow will be described a fixture made in accordance with the fourth embodiment with reference to FIGS. 22 and 23. As illustrated in FIG. 22, a fixture 322 is comprised of a main body 323 and an anchor 324. The main body 323 is formed with an eccentric cam portion 323*a* which is to make contact with the grating member 305. The main body 323 is formed with a tapped hole 325 into which a threaded portion 326 of the anchor 324 is to be engaged. Accordingly, by driving the anchor 324 into the floor 301 in the close vicinity of an intersection of the grating member 305, engaging the tapped hole 325 of the main body 323 into the anchor of 324, and then gradually rotating the main body 323, the eccentric cam portion 323*a* makes contact with the grating member 305. Thus, as shown with a solid line in FIG. 24, the tension force is imparted to the grating member 305 in a plane thereof.

Since the main body 323 is formed at a summit thereof with a nut 327, it is relatively easy to rotate the main body 323 with a tool such as a spanner. Similarly to the earlier mentioned embodiments, a plurality of the fixtures 322 disposed at a plurality of intersections of the grating member 305 ensures that the great tension force is entirely imparted to the grating member 305.

Figure 25:
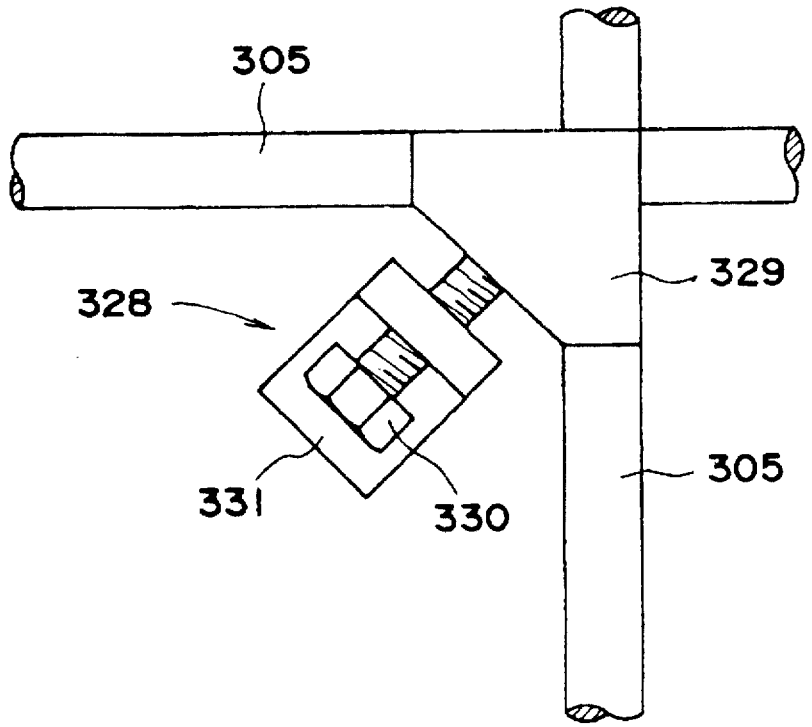
FIG. 25 is a plan view illustrating a grating member fixed with a fixture made in accordance with the fifth embodiment.

FIG. 25 is a plan view illustrating the grating member 305 fixed with a fixture 328 made in accordance with the fifth embodiment of the present invention. The fixture 328 is comprised of a main body 329, a bolt 330 and a support member 331. Similarly to the earlier mentioned embodiments, the fixture 328 is used for fixing the grating member 305 onto a lower surface of the floor 301 of a concrete made bridge.

The support member 331 is fixedly secured onto a lower surface of the floor 301, and the bolt 330 is threadedly engaged to the support member 331. By is rotating the bolt 330, the tension force is imparted to the main body 329 in a plane thereof, which main body 329 is secured to an intersection of the grating member 305. Thus, the grating member 305 can be fixed to a lower surface of the floor 301 with the tension force being imparted to the grating member 305. Since the application of the tension force is carried out merely by rotating the bolt 330, the tension force can be easily applied, and it is possible to slightly control the tension force.

Figure 26:
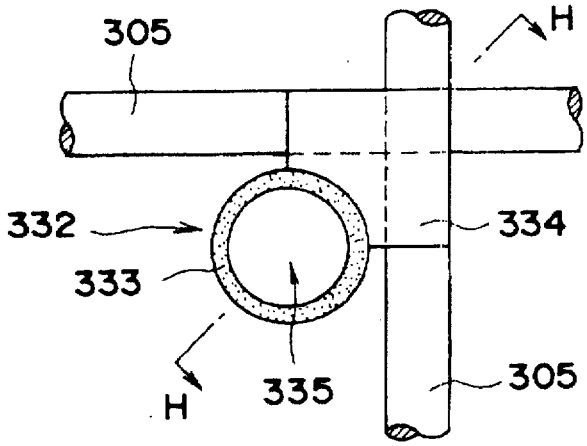
FIG. 26 is a plan view illustrating a grating member fixed with a fixture made in accordance with the sixth embodiment.
Figure 27A:
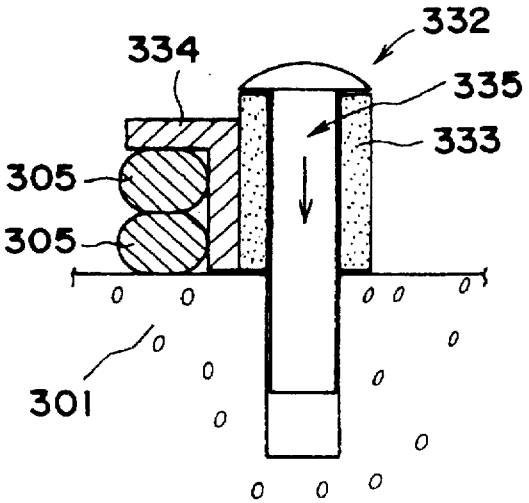
FIGS. 27A and 27B are cross-sectional view taken along the line H—H in FIG. 26.
Figure 27B:
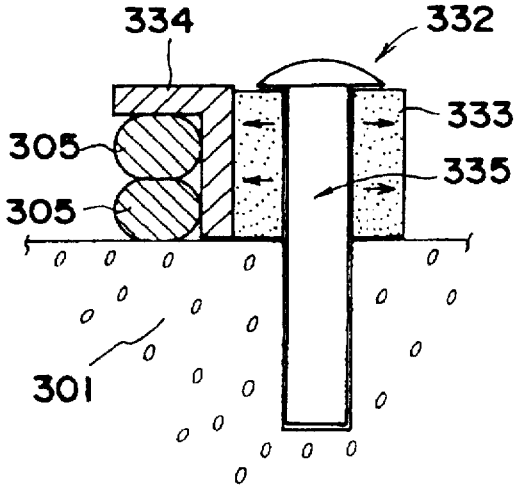

Hereinbelow will be described a fixture made in accordance with the sixth embodiment with reference to FIGS. 26, 27A and 27B. FIG. 26 is a plan view illustrating the grating member 305 fixed with a fixture 332, and FIGS. 27A and 27B are cross-sectional view taken along the line H—H in FIG. 26.

Similarly to the above mentioned embodiments, the fixture 332 is used for fixing the grating member 305 onto a lower surface of the floor 301 of a concrete made bridge. The fixture 332 is comprised of a main body 333 deformable by pressure, an aid 334, and an anchor 335. By setting the fixture 332 at an intersection of the grating member 305 and then driving the anchor 335 into the floor 301 through the main body 333, as illustrated in FIGS. 27A and 27B, the main body 333 is forced to be deformed by the driving force. Thus, the expansion of the main body 333 caused by the deformation thereof imparts the tension force to the grating member 305. The grating member 305 is fixed under such condition. In this embodiment, it is possible to obtain uniform tension force because the tension force is applied to the grating member 305 due to the deformation of the main body 333.

Figure 28:
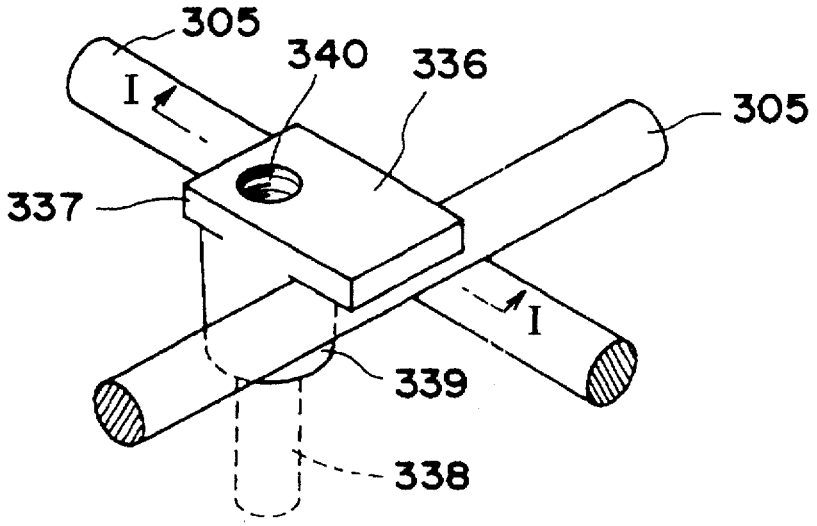
FIG. 28 is a plan view illustrating a grating member fixed with a fixture made in accordance with the seventh embodiment.
Figure 29:
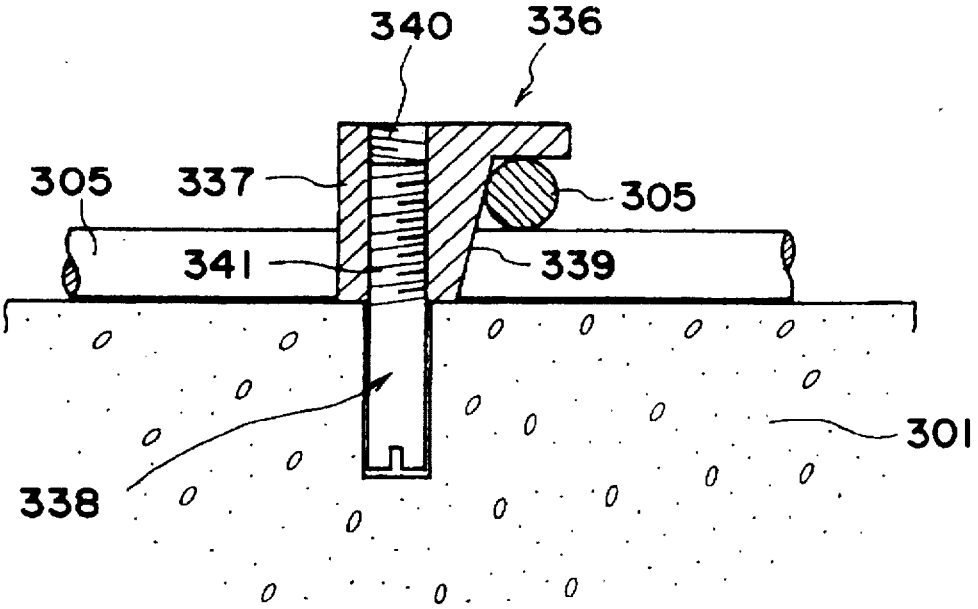
FIG. 29 is a cross-sectional view taken along the line I—I in FIG. 28.

Hereinbelow will be described a fixture made in accordance with the seventh embodiment with reference to FIGS. 28 and 29. FIG. 28 is a plan view illustrating the grating member 305 fixed with a fixture 336, and FIG. 29 is a cross-sectional view taken along the line I—I in FIG. 28.

Similarly to the above mentioned embodiments, the fixture 336 is used for fixing the grating member 305 onto a lower surface of the floor 301 of a is concrete made bridge. The fixation is carried out by setting the fixtures 336 at intersections of the grating member 305.

As illustrated in FIG. 28, the fixture 336 is comprised of a main body 337 and an anchor 338. The main body 337 is formed with an inclined guide surface 339 which is to make contact with the grating member 305. The main body 337 is formed also with a tapped hole 340 into which a threaded portion 341 of the anchor 338 is engaged. Accordingly, by driving the anchor 338 into the floor 301 at an intersection of the grating member 305, engaging the tapped hole 340 of the main body 337 to the anchor 338, and then gradually rotating the main body 337, the inclined guide surface 339 making contact with the grating member 305 imparts the tension force to the grating member 305 in a plane thereof.

It is possible to control the tension force to be applied to the grating member 305 by controlling rotation angle of the main body 337. Similarly to the above mentioned embodiments, a plurality of the fixtures 336 disposed at a plurality of intersections of the grating member 305 ensures that the tension force is entirely imparted to the grating member 305.

Figure 30:
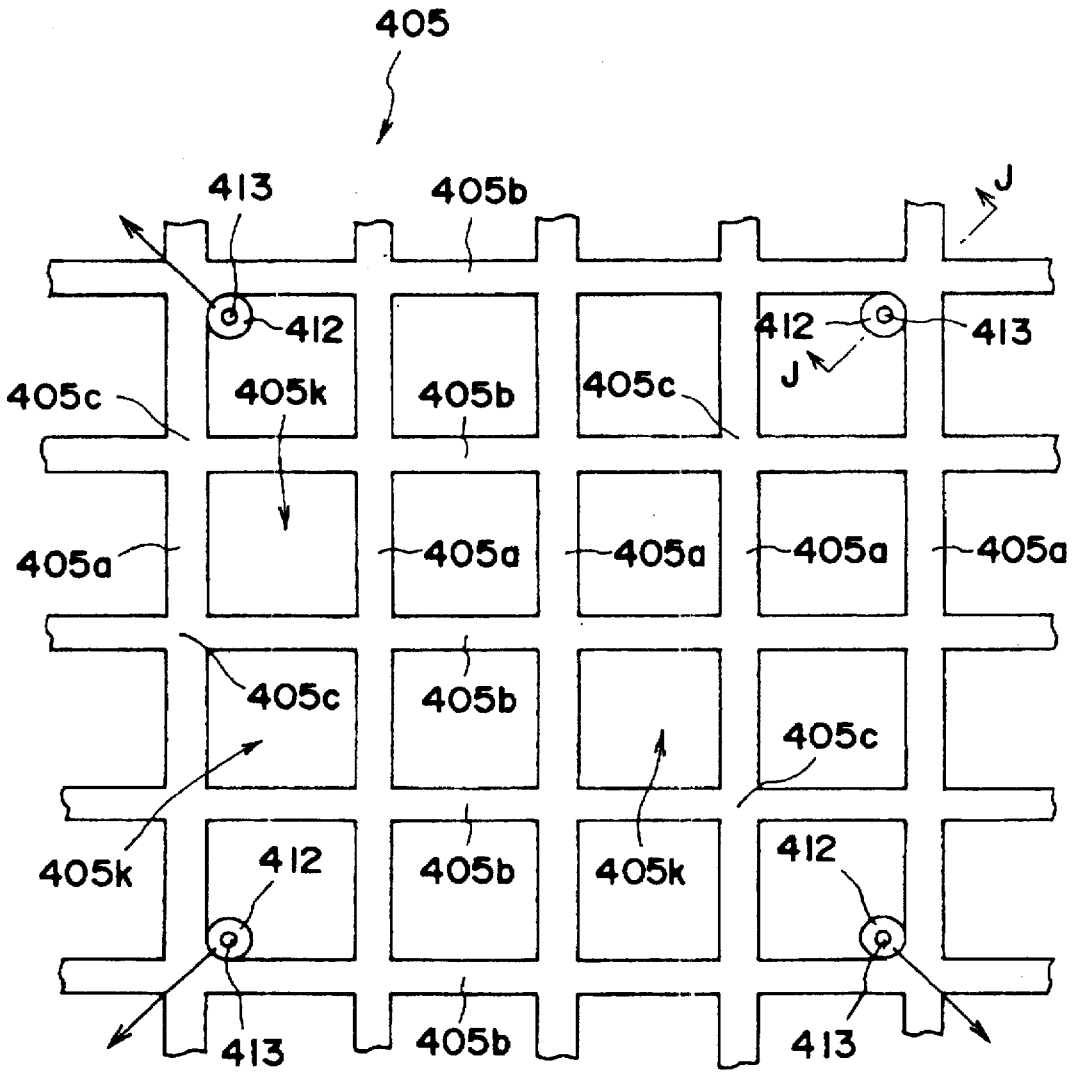
FIG. 30 is a plan view illustrating a reinforcement member made in accordance with the present invention.
Figure 31A:
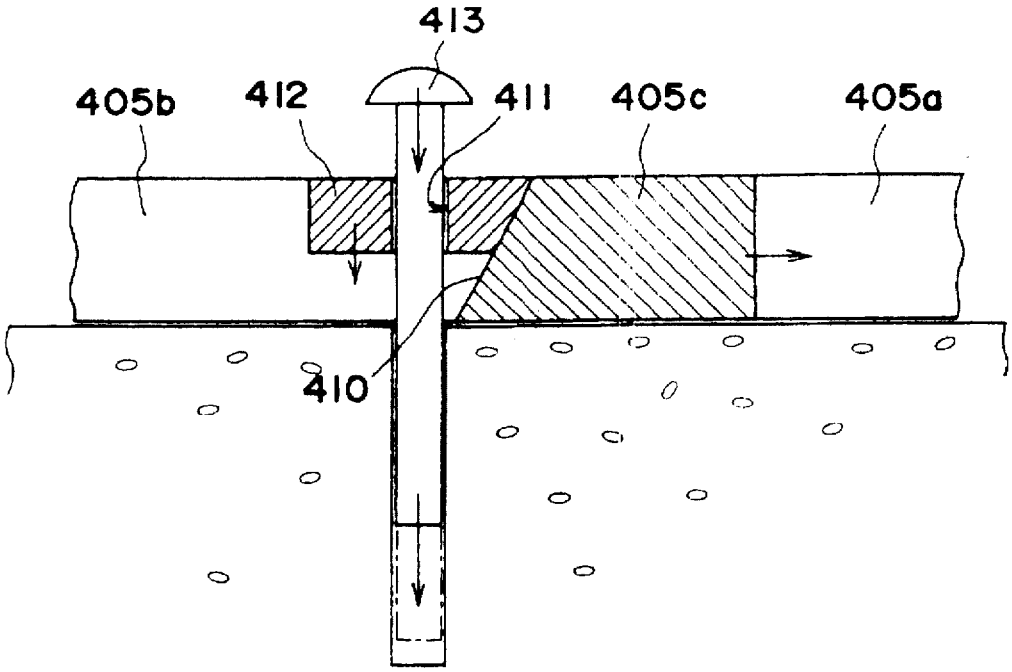
FIGS. 31A and 31B are cross-sectional view taken along the line J—J in FIG. 30.
Figure 31B:
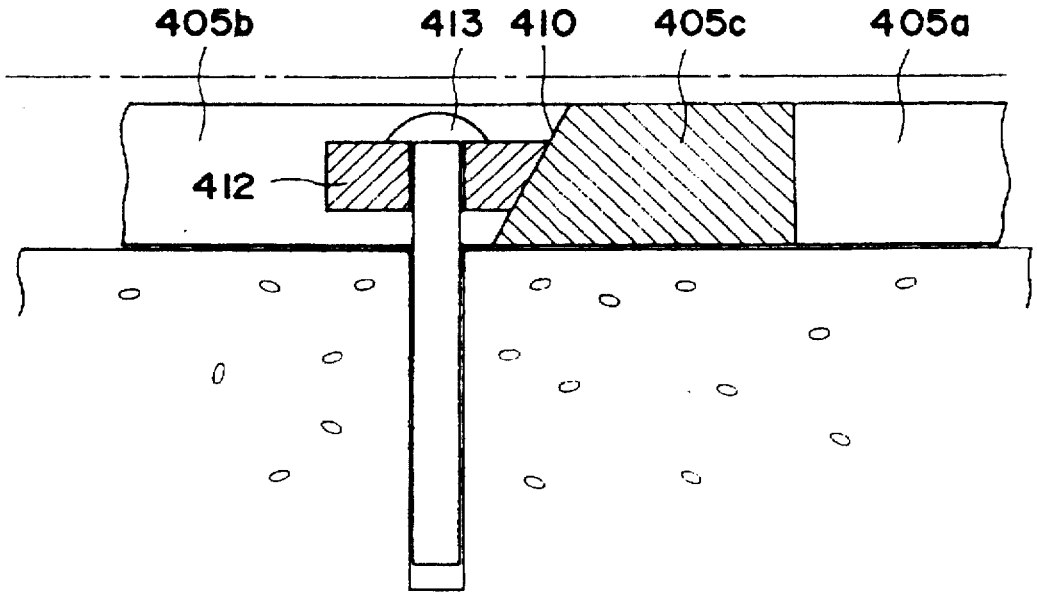

Hereinbelow will be explained a reinforcement member to be fixed onto a lower surface of a concrete made construction with reference to FIGS. 30, 31A and 31B. FIG. 30 is a plan view of a reinforcement member, and FIGS. 31A and 31B are cross-sectional views taken along the line J—J in FIG. 30.

The reinforcement member 405 is used for reinforcing an existing construction by fixing onto a lower surface of the construction such as a bridge. The reinforcement member 405 is comprised of vertical portions 405*c* and horizontal portions 405*b* both of which lie in a common plane. Thus, the vertical portions 405*c* do not overlap the horizontal portions 405*b* at intersections 405*c*, and hence the grating member 405 has a thickness equal to that of the vertical portions 405*c* or horizontal portions 405*b*.

The grating member 405 is made of steel, and hence has high processability because of which the grating member can be formed in various sizes and shapes. Furthermore, the grating member 405 has superior adhesion property to concrete mortar. A method of fabricating the reinforcement member 405 is not limited to a specific one. For instance, the grating member 405 can be formed by stamping a steel plate to remove portions, which would leave openings 405*k* behind.

In order to fix the grating member 405 onto a lower surface of a concrete made construction with tension force being imparted to the grating member 405, the grating member 405 is provided with a tensioning device comprising an inclined guide surface 410 formed at an intersection 405*c* of the grating member 405, and an aid 412 making contact with the inclined guide surface 410 and formed with a hole 411 into which an anchor is to be inserted.

Thus, by driving an anchor 413 into a concrete made construction through the hole 411 of the aid 412 when the grating member 405 is to be fixed onto a lower surface of a concrete made construction, the aid is forced to move along the inclined guide surface 411 formed at the intersection 405*c* of the grating member 405, thereby the grating member 405 being fixed with the tension force being applied to the grating member 405 in a plane thereof. It is possible to control the tension force to be applied to the grating member 405 by controlling a depth by which the anchor 413 is driven into a concrete made construction.

By fixing the grating member 405 with tension force being parted thereto, the grating member 405 is kept to have pre-stress. Thus, the grating member 405 is significantly fixed to an existing concrete made construction. Hence, even if a concrete made construction to which the grating member 405 is fixed is deflected, the grating member 405 follows the deflection of the concrete made construction, which ensures enhanced fixation of the grating member to the concrete made construction.

Figure 32:
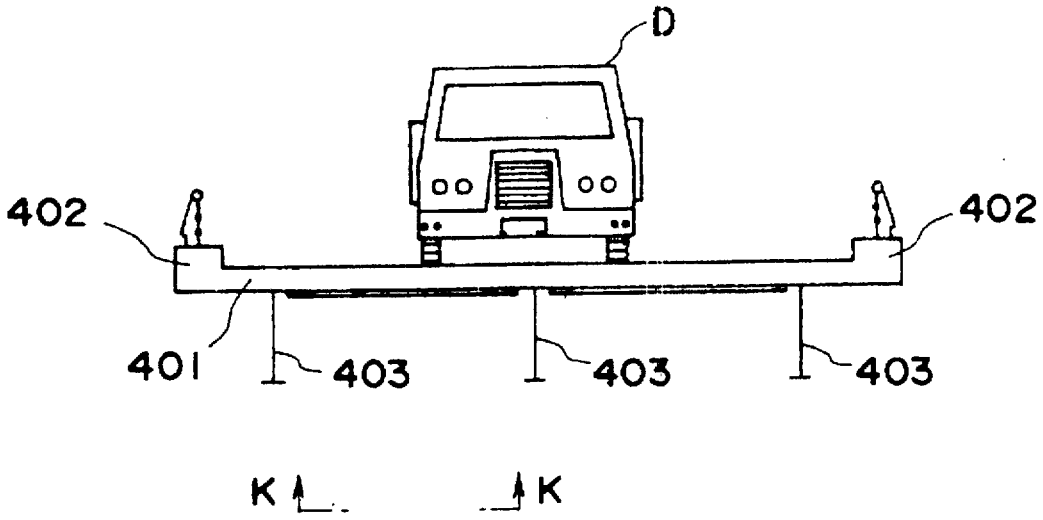
FIG. 32 is a front view of a concrete made bridge.
Figure 33:
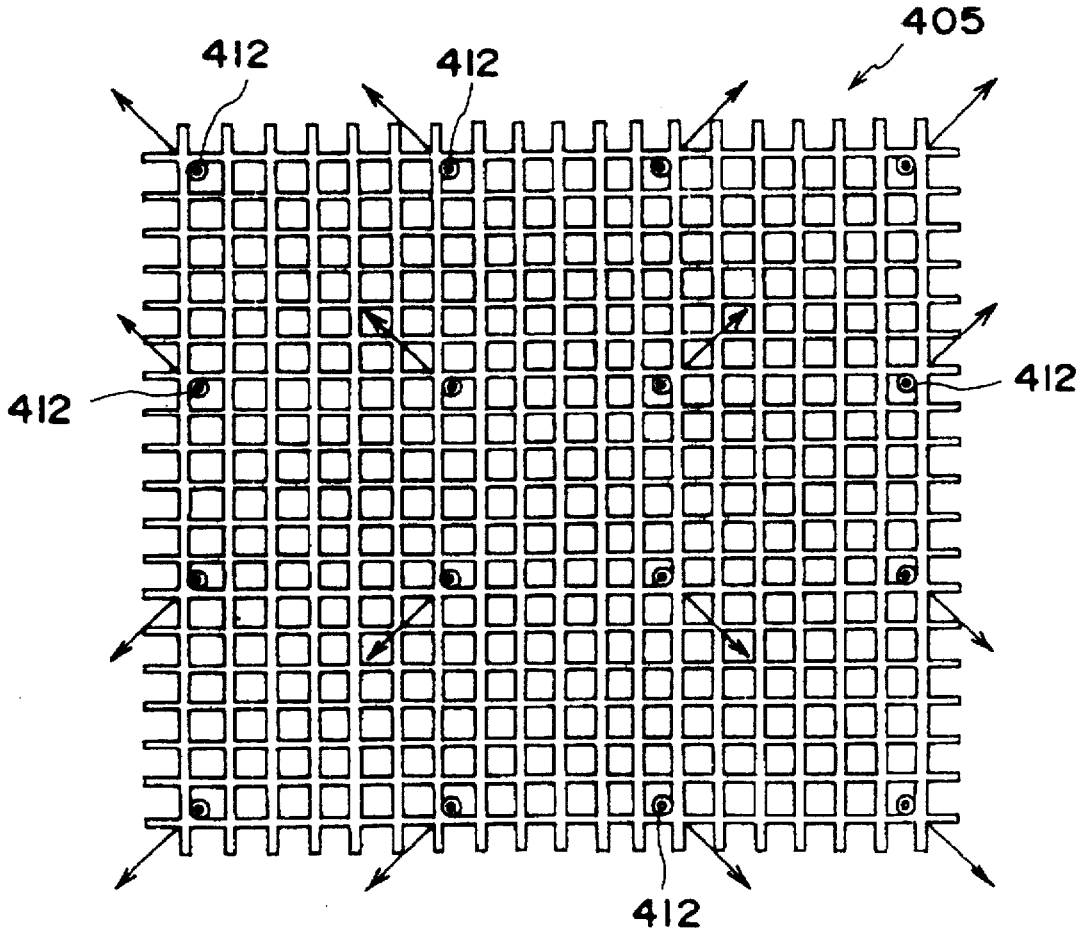
FIG. 33 is an enlarged view as viewed in a direction indicated with an arrow K in FIG. 32.

With reference to FIGS. 32 and 33, hereinbelow is explained a concrete made bridge which is reinforced by fixing the grating member 405 onto a surface thereof. FIG. 32 is a front view of a concrete made bridge, and FIG. 33 is an enlarged view as viewed in a direction indicated with an arrow K in FIG. 32.

With reference to FIG. 32, a floor 401 of a concrete made bridge is formed at opposite edges thereof with raised portions 402. The floor 401 is supported at a lower surface thereof with three pillars 403. A truck D as a live load runs on the floor 401.

As illustrated in FIG. 32. the grating member 405 is fixed onto an entire lower surface of the floor 401. The grating member 405 is provided with the tensioning device as illustrated in FIGS. 31A and 31B. As illustrated in FIG. 33, the tension force is imparted entirely to the grating member 405 in a direction indicated with arrows by fixing the grating member 405 with a plurality of the aids 412. It is possible to slightly control the tension force to be applied to the grating member 405 by controlling a depth by which the anchor 413 is driven into the floor 401, and hence the fixation of the grating member 405 can be carried out in accordance with the condition of the floor 401.

In the reinforcement of the concrete made bridge 401, the use of the grating member 405 having the tensioning device such as mentioned above makes it possible to fix the grating member 405 onto a lower surface of the floor 401 with the tension force being imparted entirely to the grating member 405 in a plane thereof. Thus, there is introduced pre-stress into the grating member 405. Hence, even if the floor 401 to which the grating member 405 is fixed is deflected, the grating member 405 moves following the deflection of the floor 401, thereby the stable fixation between the grating member 405 and the floor 401 being ensured. In the illustrated embodiment, the tension force is directed to outside from a span center of the floor 401, that is, a point at which the floor 401 has a maximum deflection caused by loads to be applied thereto and its own weight.

Then, there is introduced polymer cement mortar onto a lower surface of the floor 401 to there form a covering layer which entirely covers the grating member 405 therewith. The reinforcement of the floor 401 is thus completed. Since the intersections 405*c* of the grating member 405 has no overlapping portions, it is possible to form the covering layer thinner than a covering layer formed in accordance with a conventional method, and thereby it is possible to remarkably reduce an amount of covering material such as polymer cement mortar.

Figure 34:
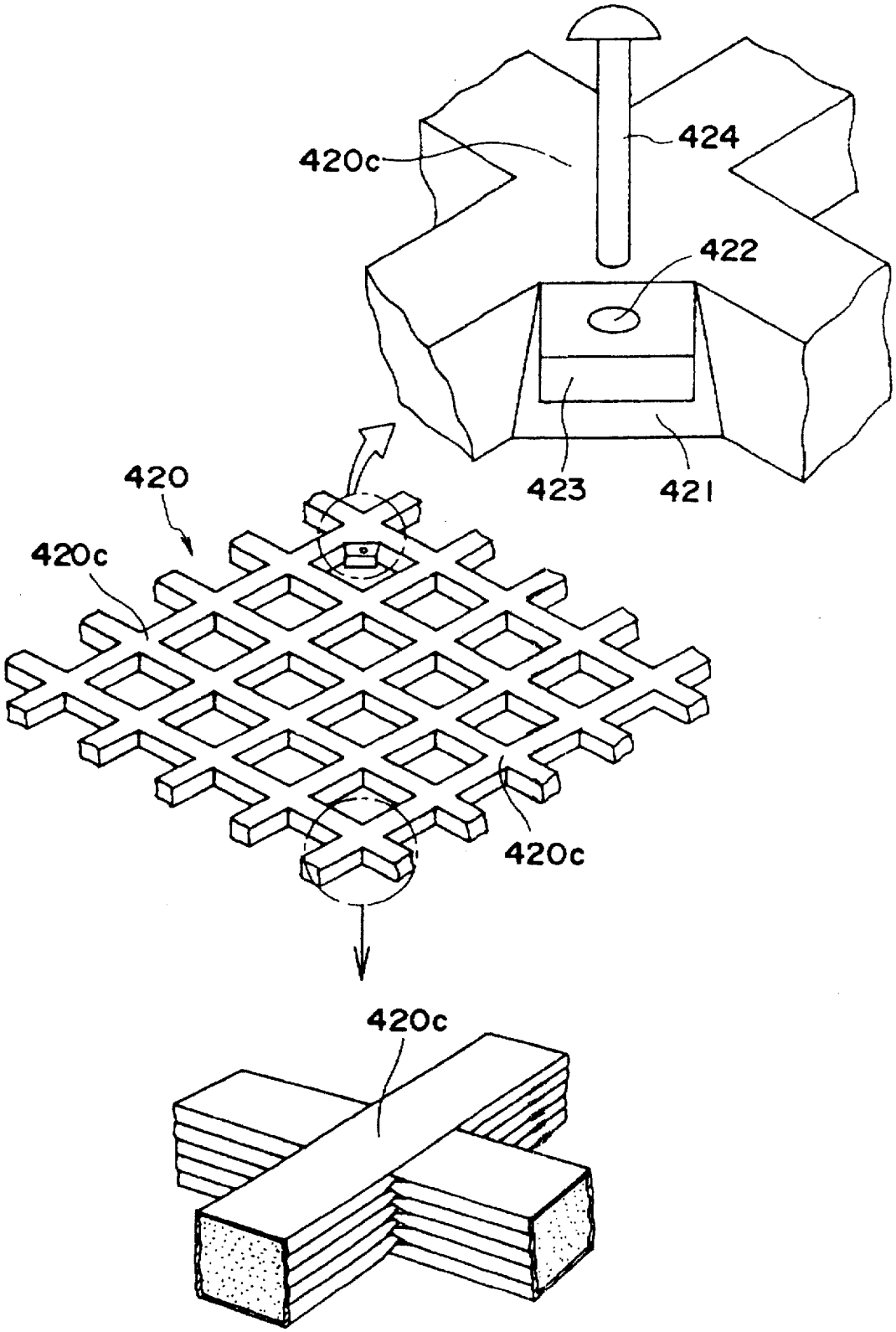
FIG. 34 is a perspective view illustrating a reinforcement member made in accordance with another embodiment of the present invention.

Hereinbelow is described another embodiment of a reinforcement member with reference to FIG. 34. A grating member 420 illustrated in FIG. 34 is made of fiber-reinforced resin. By making the grating member 420 of fiber-reinforced resin, the grating member 420 weights lighter and comes to have enhanced corrosion resistance and chemical resistance. As fiber-reinforced resin, there may be used "Nefcom (registered trade mark)" available from Nefcom Co., Ltd. In addition, the grating member 420 made of fiber-reinforced resin has lighter weight and greater strength than steel.

The intersections 420*c* of the grating member 420 have a laminated structure formed by alternately depositing fibers, thereby providing great bonding force which ensures sufficient strength for the tension force to be applied to the intersections by means of a fixture. Furthermore, since the intersections lie in a common plane unlike a reinforcing steel, it is possible to make the grating member thinner. Hence, it is possible to make the covering layer thinner than a covering layer formed in accordance with a conventional method, which in turn makes it possible to remarkably reduce an amount of polymer cement mortar to be used for forming the covering layer.

In order to fix the grating member 420 onto a lower surface of a concrete made construction with the tension force being applied to the grating member 420, the grating member 420 is provided with means for imparting tension force, comprising an inclined guide surface 421 formed at the intersection 420*c*, and an aid 423 making contact with the inclined guide surface 421 and formed with a hole 422 into which an anchor is inserted.

Thus, by driving an anchor 424 into a concrete made construction through the hole 422 of the aid 423 when the grating member 420 is to be fixed onto a lower surface of a concrete made construction, the aid 423 is forced to move along the inclined guide surface 421 formed at the intersection 420*c* of the grating member 420, thereby the grating member 420 being fixed with the tension force being applied to the grating member 420 in a plane thereof. Accordingly, it is possible to fix the grating member 420 onto a lower surface of a concrete made construction with the tension force being applied entirely to the grating member 420 by providing the inclined guide surfaces 421 and aids 423 at a plurality of sites of the grating member 420. It is possible to control the tension force to be applied to the grating member 420 by controlling a depth by which the anchor 424 is driven into a concrete made construction.

The present invention, which have been described in connection with the preferred embodiments, provides advantageous effects as follows.

The method of the present invention imparts pre-stress to a reinforcement member fixed onto a lower surface of a concrete made construction. Thus, even if a concrete made construction to which the reinforcement member is fixed is deflected, the reinforcement member moves following the deflection of a concrete made construction, thereby a gap being never generated between the reinforcement member and a fixture. Hence, the fixation of the reinforcement member to a concrete made construction can be enhanced, and thereby it is possible to maintain the reinforcing effect in a long time. In particular, it is possible to certainly fix a reinforcement member to a floor of a bridge which would make deflection while fixtures are being fixed thereto. In addition, it is possible to insert fixtures into a concrete made construction with higher accuracy by forming holes, to which the fixtures are to be inserted, with a reinforcement member being provisionally secured to a concrete made construction, relative to a conventional method in which holes to which fixtures are to be inserted are formed in advance. Thus, the insertion of fixtures ensures introduction of pre-stress to a reinforcement member.

The fixture made in accordance with the present invention makes it is possible to fix a reinforcement member onto a lower surface of a concrete made construction with tension force being imparted to the reinforcement member in a plane thereof, and thus there is introduced so-called pre-stress into the reinforcement member, which enhances the fixation between the reinforcement member and a concrete made construction.

The reinforcement member made in accordance with the present invention facilitates the fixation of a reinforcement member onto a lower surface of a concrete made construction, and enhances reinforcing effects.

The reinforcement member made of fiber-reinforced resin provides safety in the fixation, and facilitates the fixation thereof onto a lower surface of a concrete made construction. In addition, since the reinforcement member made of fiber-reinforced resin has smaller surface hardness than steel, even if a handy drill accidentally makes contact with the reinforcement member, the reinforcement member is merely shaved slightly at a surface thereof. The reinforcement member is never got out of position unlike a reinforcing steel. Furthermore, since fiber-reinforced resin has an elastic deformation band two to five times greater than a PC steel stranded wire, the fixation of a reinforcement member onto an existing concrete made construction can be enhanced.

In addition, the reinforcement member made of fiber-reinforced resin is composed of vertical and horizontal portions both of which lie in a common plane, and thus the vertical and horizontal portions never overlap with each other, thereby it is possible to reduce a thickness of the reinforcement member.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A method of reinforcing a concrete made construction comprising the steps of:

disposing a reinforcement member onto a lower surface of the concrete made construction;

forming holes at said lower surface of the concrete made construction; and inserting fixtures having an inclined surface into said holes to fix said reinforcement member onto said lower surface of a concrete made construction, wherein the inclined surface is in contact with the reinforcement member and the fixture imparts a tension force to said reinforcement member in a plane of said reinforcement member.

2. The method as set forth in claim 1, wherein said concrete construction is a bridge.

3. The method as set forth in claim 1 further comprising the step of covering said reinforcement member with a covering layer.

4. The method as set forth in claim 3, wherein said covering layer is applied by direct application thereof onto said lower surface of the concrete made construction.

5. The method as set forth in claim 3, wherein said covering layer is applied by positioning a frame onto said lower surface of the concrete made construction and introducing covering material into said frame.

6. The method as act forth in claim 3, wherein said covering layer is applied by spraying.

7. The method as set forth in claim 1 further comprising the step of surface-treating said lower surface of the concrete made construction with high-pressure water-washing surface preparation or sand blast before said reinforcement member is fixated onto said lower surface of a concrete made construction.

8. A combination of a fixture and a reinforcement member both of which are to be used in a method of reinforcing a concrete made construction including the step of fixing a reinforcement member onto a lower surface of a concrete made construction with tension force being applied to said reinforcement member in a plane thereof by means of said fixture, said reinforcement member being formed with an inclined guide surface for imparting tension force to said reinforcement member, said fixture including an inclined surface which makes contact with said inclined guide surface of said reinforcement member when said fixture is inserted into the concrete made construction, to impart tension force to said reinforcement member in said plane thereof.

9. The combination as set forth in claim 8, wherein said reinforcement member is a mesh-type reinforcing steel formed by welding steel in a grid.

10. The combination as set forth in claim 8, wherein said reinforcement member is a grating member made of fiber-reinforced resin.

11. The combination as set forth in claim 9, wherein said reinforcement member comprises portions extending in a first direction and portions extending in a second direction, wherein the first and second directions lie in a common plane.

12. The combination as set forth in claim 10, wherein said reinforcement member comprises portions extending in a first direction and portions extending in a second direction, wherein the first and second directions lie in a common plane.

13. The method as set forth in claim 1, wherein said step of inserting fixtures further comprises the steps of:

(1) providing a plurality of fixtures each including an anchor and a pin, said anchor including a head portion, a shaft portion extending from said head portion, an expanding slot formed at a tip of the anchor distal to the head portion, and a through hole extending axially through the head portion and the shaft;

wherein said inclined surface is formed on the shaft between the head portion and an intermediate portion between the head and the tip; and said pin constructed to fit in the through hole and expand the expanding slot when driven into the through hole; and (2) inserting said anchors into said holes at the lower surface of the concrete construction and driving said pins into said through holes of said anchors to thereby fix said reinforcement member.

14. The method as set forth in claim 13, wherein said anchor further comprises a resin layer covering said inclined surface.

* * * * *

UNITED STATES PATENT AND TRADEMARK OFFICE

CERTIFICATE OF CORRECTION

PATENT NO. : 5,678,374

DATED : October 21, 1997

INVENTOR(S) : Katsumi Fukuoka

It is certified that error appears in the above-identified patent and that said Letters Patent is hereby corrected as shown below:

On the cover page of the patent, at section "(30) Foreign Application Priority Date," insert the following two Japanese priority applications:

-- April 24, 1996 (JP) Japan ..... 8-128985
April 24, 1996 (JP) Japan .....8-128986 --.

Signed and Sealed this

Eighth Day of December, 1998

Bruce Lehman

*Attest:*

BRUCE LEHMAN

*Attesting Officer*

*Commissioner of Patents and Trademarks*